US005620174A

United States Patent [19]

Taniguro et al.

[11] Patent Number: 5,620,174

[45] Date of Patent: Apr. 15, 1997

[54] SHEET CONVEYING APPARATUS

[75] Inventors: Masahiro Taniguro; Tetsuo Suzuki; Soichi Hiramatsu; Hiroyuki Saito; Haruyuki Yanagi, all of Yokohama; Takashi Nojima, Tokyo; Satoshi Saikawa, Inagi; Hiroyuki Kinoshita, Kawasaki; Hideaki Kawakami, Yokohama, all of Japan

[73] Assignee: Canon Kabushiki Kaisha, Tokyo, Japan

[21] Appl. No.: 674,990

[22] Filed: Jul. 3, 1996

Related U.S. Application Data

[60] Continuation of Ser. No. 455,539, May 31, 1995, abandoned, which is a division of Ser. No. 97,199, Jul. 27, 1993, abandoned.

[30] Foreign Application Priority Data

Jul. 31, 1992 [JP] Japan ..... 4-225147
Jul. 31, 1992 [JP] Japan ..... 4-225148

[51] Int. Cl.[6] ..... B65H 5/00

[52] U.S. Cl. ..... 271/10.12; 271/272; 271/274; 271/242; 271/902; 277/265.04; 277/10.02; 400/636

[58] Field of Search ..... 271/272–274, 271/4.1, 10.11, 10.12, 10.13, 242, 245, 902, 2, 10.02, 265.04; 400/624, 630, 636

[56] References Cited

U.S. PATENT DOCUMENTS

| | | | |
|---|---|---|---|
| 1,145,017 | 7/1915 | Hess . | |
| 4,215,945 | 8/1980 | Habich et al. | 400/636 |
| 4,990,011 | 2/1991 | Underwood et al. | 271/242 |
| 5,154,411 | 10/1992 | Saito et al. . | |
| 5,177,547 | 1/1993 | Kanemitsu et al. | 271/902 |
| 5,222,724 | 6/1993 | Hirano et al. | 271/902 |

FOREIGN PATENT DOCUMENTS

| | | | |
|---|---|---|---|
| 0015314 | 9/1980 | European Pat. Off. . | |
| 60-19571 | 1/1985 | Japan . | |
| 0278069 | 12/1987 | Japan . | |
| 63-51230 | 3/1988 | Japan | 271/4.1 |
| 0150651 | 6/1989 | Japan . | |
| 0243438 | 9/1990 | Japan . | |
| 3-138243 | 6/1991 | Japan | 271/242 |

OTHER PUBLICATIONS

"Cardholder and Paper Bail", J.N. Cassell, IBM Technical Disclosure Bulletin, vol. 13, No. 11, Apr. 1971, p. 3539.

*Primary Examiner*—H. Grant Skaggs
*Attorney, Agent, or Firm*—Fitzpatrick, Cella, Harper & Scinto

[57] ABSTRACT

The present invention provides a sheet conveying apparatus with a convey roller for conveying a sheet; a plurality of pinch rollers arranged along the convey roller and adapted to urge the sheet against the convey roller; a pinch roller holder formed as one piece for supporting the plurality of pinch rollers, the rigidity of the pinch roller holder in a sheet conveying direction being greater than the rigidity of the pinch roller holder in a direction perpendicular to the sheet conveying direction; and a biasing device for acting on the pinch roller holder to urge the pinch rollers against the convey roller.

18 Claims, 19 Drawing Sheets

| |
|---|
| FIG. 19A |
| FIG. 19B |

SHEET CONVEYING APPARATUS

This application is a continuation of application Ser. No. 08/455,539, filed May 31, 1995, which is a divisional of application Ser. No. 08/097,199, filed Jul. 27, 1993, now both abandoned.

BACKGROUND OF THE INVENTION

1. Field of the Invention

The present invention relates to a sheet conveying apparatus for conveying a recording sheet in a printer, typewriter, copying machine and the like and a conveying apparatus for conveying an original to be read in a facsimile system, copying machine, image reader, OCR and the like, and more particularly, it relates to a sheet conveying apparatus useful for systems wherein a sheet being conveyed should not be floating at a desired position.

2. Related Background Art

In the past, sheet conveying apparatuses used with a printer, scanner and the like are mainly of the type wherein pinch rollers are urged against a convey roller comprising a high friction surface member so that a sheet pinched between the convey roller and the pinch rollers is conveyed by friction forces generated between the rollers. According to one aspect, each pinch roller is mounted on a corresponding pinch roller holder made of plastic material and is biased toward a convey roller by a spring and the like.

In the conventional sheet conveying apparatuses, it is necessary to provide one pinch roller holder for each pinch roller, and, since any gap must be maintained between the adjacent pinch roller holders, it is very difficult to urge the whole sheet against the convey roller uniformly. Thus, in an apparatus wherein a sheet being conveyed should not be floating at a desired position, there arises a problem if the sheet cannot be uniformly urged against the convey roller. Particularly, in an ink jet printer, since the sheet gets wet due to the ink discharged from a recording head, a recording surface of the sheet is floating, thereby deteriorating the recording quality.

To avoid this, a plurality of pinch rollers may be mounted on a single pinch roller holder. In this case, however, if the single pinch roller holder is distorted or twisted, there arises the dispersion in the urging forces of the pinch rollers, thus causing a problem that gaps are created between some pinch rollers and the convey roller.

The recording apparatuses can be grouped into ink jet type, wire dot type, thermal type, electrophotographic type or the like on the basis of the recording modes. The recording apparatus of ink jet type has many advantages that it has low noise, low running cost, low apparatus cost, high speed recording ability and compact body. Further, generally, since the recording head is not contacted with the recording sheet, by maintaining a small and constant gap between the recording head and the recording sheet, it is possible to obtain the high image quality. To this end, the recording sheet is held down by pinch rollers arranged near the recording head. In this case, since the recording sheet is held down in the proximity of the recording head, diameters of the pinch rollers are made smaller.

However, when the conveyance of the recording sheet and the registration of the recording sheet are effected by using the small pinch rollers and the convey roller, since a nip between each pinch roller and the convey roller is small, if a thick sheet such as a post card is handled, the sheet cannot be adequately pinched between the nips, thereby causing the poor protruded amount and the poor registration.

SUMMARY OF THE INVENTION

An object of the present invention is to provide a sheet conveying apparatus which can prevent the floating of a sheet to avoid the deterioration of the recording quality.

To achieve the above object, there is provided a sheet conveying apparatus comprising a convey roller, a plurality of pinch rollers, and an urging means for urging the pinch rollers against the convey roller, and wherein the urging means serves to afford an urging force to a pinch roller holder which is formed from one-piece and to which the plurality of pinch rollers are attached.

Preferably, the rigidity of the pinch roller holder in a sheet conveying direction is considerably greater than the rigidity of the holder in a direction perpendicular to the sheet conveying direction. That is, the sheet is supported by the convey roller and the pinch roller holder and is conveyed by the pinch rollers urged against the convey roller. The rigidity of the pinch roller holder in the sheet conveying direction is considerably greater than the rigidity of the holder in the direction perpendicular to the sheet conveying direction. Thus, the lateral camber and torsion generated in the manufacture of the pinch roller holder is removed by the urging force acting on the pinch roller holder, thereby preventing the floating of the sheet.

Further, another object of the present invention is to provide a recording apparatus and a controlling met hod therefor, where in a sheet can be surely inserted into a nip between a convey roller and pinch rollers urged against the convey roller.

To achieve the above object, there is provided a recording apparatus comprising a convey means for conveying a sheet and a recording head for performing the recording regarding the sheet, and wherein the convey means comprises a convey roller, a pinch roller urged against the convey roller and adapted to generate a conveying force for conveying the sheet, and a pinch roller abutting means for abutting the pinch roller against the convey roller with a predetermined pressure, and a protruded portion is provided at a position on the pinch roller abutting means opposed to the convey roller at an upstream side of a nip between the convey roller and the pinch roller.

Further, there is provided a recording apparatus comprising a convey means for conveying a sheet and a recording head for performing the recording regarding the sheet, and further comprising a plurality of sheet supply modes having different sheet feed amounts and sheet return amounts, and a control means for controlling the convey means on the basis of the sheet supply mode.

When the recording sheet to be recorded is sent to the convey roller, the recording sheet is inserted into the nip between the convey roller and the pinch rollers urged against the convey roller and then is conveyed by these rollers. When the recording sheet is inserted into the nip, a tip end or leading end of the recording sheet is abutted against the convey roller by the protruded portion, thereby guiding the sheet to the nip. In this way, even when the pinch rollers having a small diameter are used, it is possible to prevent the poor pinching of the pinch rollers, the poor protruded amount of the sheet and the poor registration of the sheet. Further, even a thick sheet such as a post card can be surely conveyed similar to the normal sheet.

DETAILED DESCRIPTION OF THE PREFERRED EMBODIMENTS

First of all, a first embodiment of the present invention will be explained with reference to FIGS. 1 to 4. This embodiment shows a recording apparatus integrally incorporating an automatic sheet supplying device and comprising a sheet supply portion, a sheet conveying portion, a sheet discharge portion, a carriage portion, and a cleaning portion. First of all, constructions and operations of these portions will be briefly described.

Figure 1:
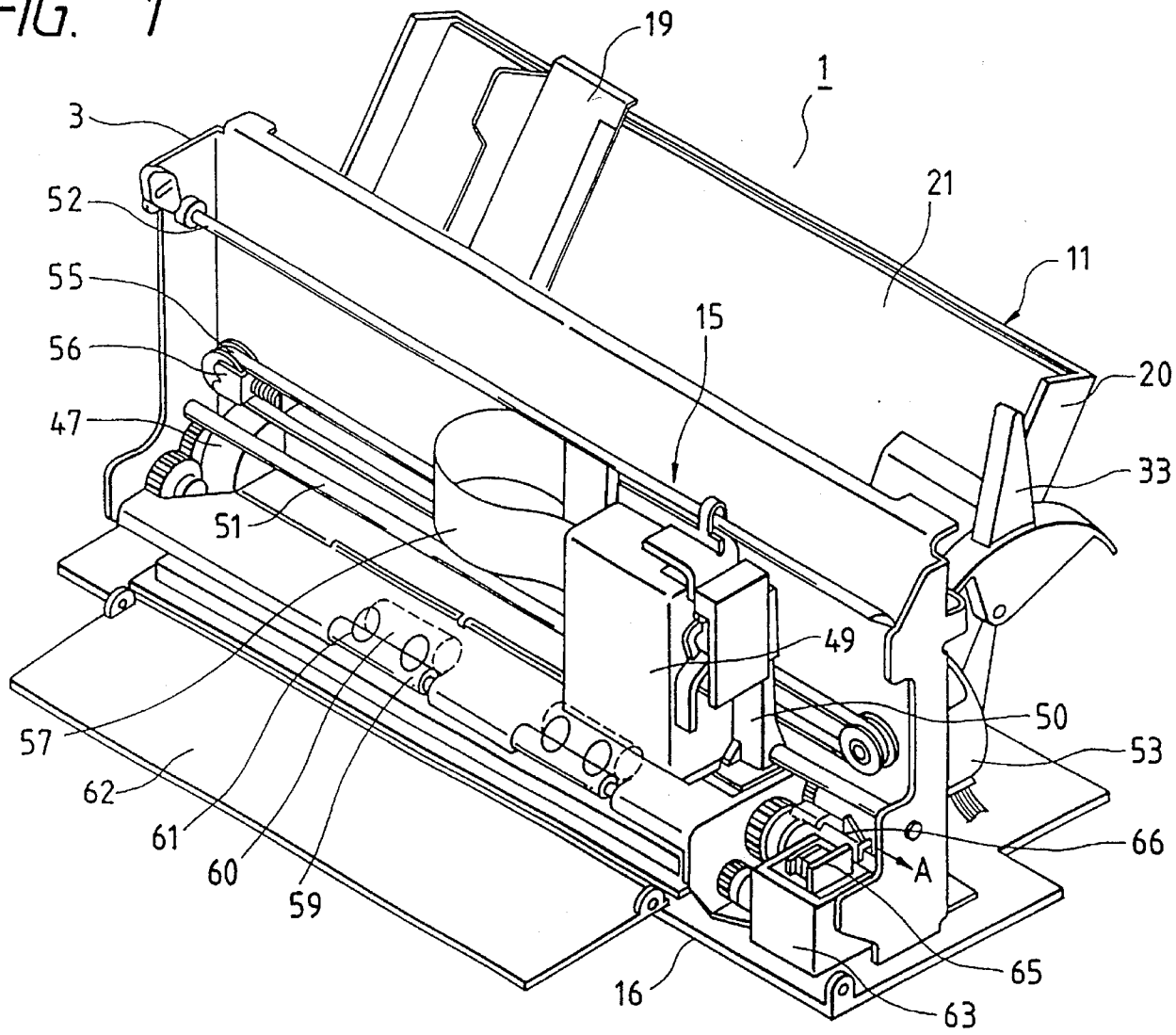
FIG. 1 is a perspective view of a recording apparatus according to a first embodiment of the present invention.
Figure 2:
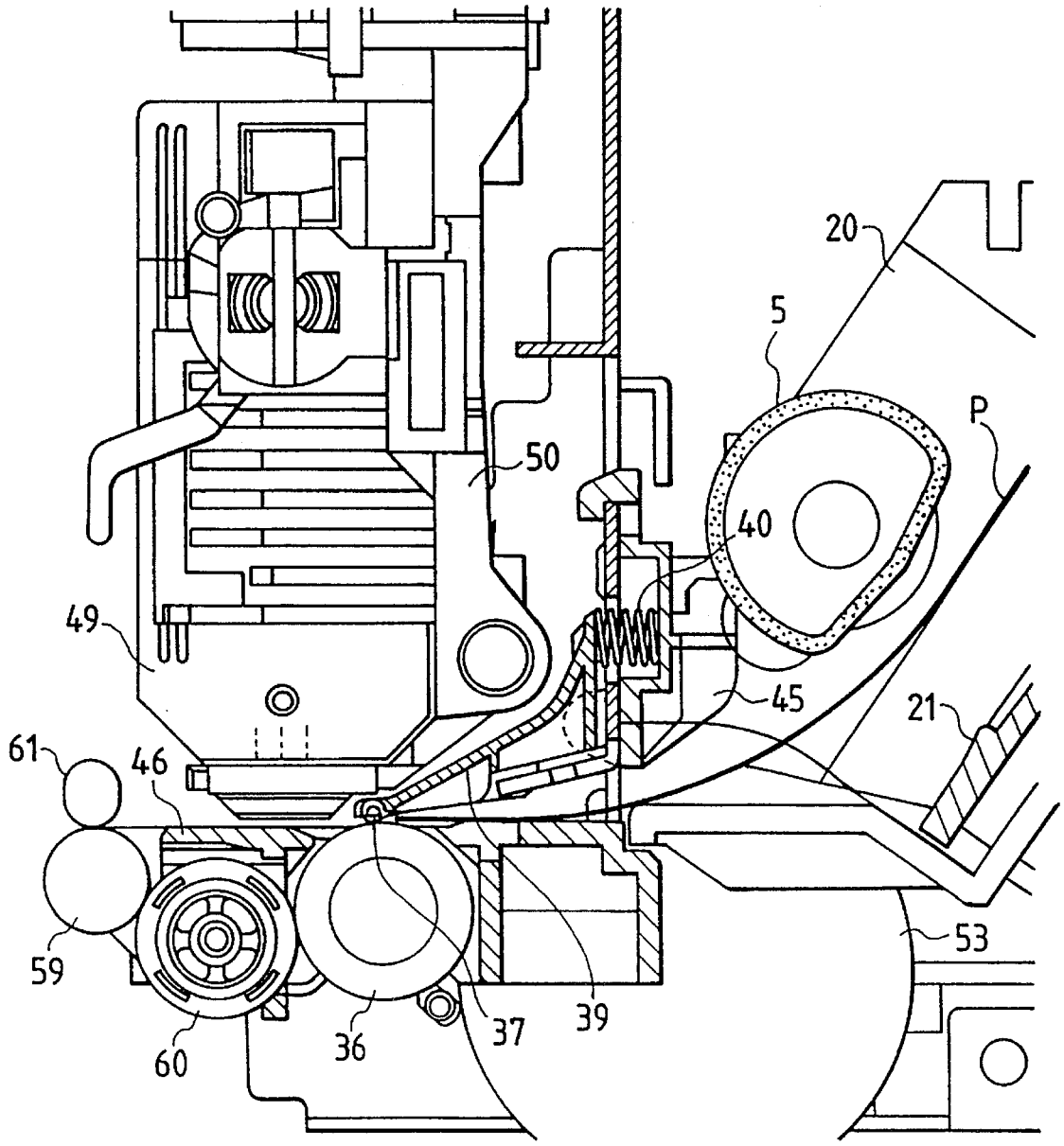
FIG. 2 is a side sectional view of a sheet conveying mechanism of the recording apparatus.

FIG. 1 is a perspective view showing a whole construction of the recording apparatus, and FIG. 2 is a sectional view showing the whole construction of the recording apparatus.

The sheet supply portion 11 is attached to a body of the recording apparatus at an angle of 30–60 degrees. A recording sheet P fed from the sheet supply portion is recorded, and then is discharged horizontally. The sheet supply portion 11 comprises a sheet supply roller 5, separating claws (not shown), a movable side guide 19, a base 20, a pressure plate 21, a compression spring, a release lever 33, and a release cam 35. The recording sheets P are picked up by the rotation of the sheet supply roller 5 and then are separated one by one by the separating claws (not shown). The separated recording sheet P is sent to the sheet conveying portion.

The sheet conveying portion 12 comprises a convey roller 36, pinch rollers 37, a pinch roller guide 39, pinch roller springs 40, an upper guide 45 and a platen 46. The recording sheet P sent to the sheet conveying portion 12 is conveyed to a nip between the convey roller 36 and the pinch rollers 37 while being guided by the platen 46, pinch roller guide 39 and upper guide 45. A PE sensor lever (not shown) serves to detect a tip end (leading end) of the recording sheet P, thereby determining a printing position on the recording sheet P. The pinch rollers 37 are urged against the convey roller 36 by biasing the pinch roller guide 39 by the pinch roller springs 40, thereby generating a conveying force for the recording sheet P. The recording sheet P conveyed by the paired rollers 36, 37 is advanced on and along the platen 46 by rotating the paired rollers 36, 37 by an LF motor 47; meanwhile, an image is recorded on the recording sheet by a recording head 49 on the basis of desired image information. The recording head 49 is integrally formed with an ink tank to provide an easily exchangeable ink jet recording head unit. The recording head 49 includes electrothermal converters so that the ink is discharged from an ink discharge opening by utilizing the change in pressure due to growth and contraction of a bubble caused by the film boiling generated when thermal energy is applied to the selected converter.

The carriage portion 15 comprises a carriage 50 to which the recording head 49 is attached, a guide shaft 51 for reciprocally guiding the carriage in a direction perpendicular to a sheet conveying direction, a guide 52 for holding a rear end of the carriage and for maintaining a gap between the recording head and the recording sheet, a timing belt 55 for transmitting a driving force of a carriage motor 53 to the carriage 50, idle pulleys 56 for supporting the timing belt 55, and a flexible cable 57 for transmitting a head drive signal from an electric substrate to the recording head 49. The image is recorded on the recording sheet P being conveyed on the platen 46 by scanning the recording head 49 mounted on the carriage 50.

The sheet discharge portion comprises a sheet discharge roller 59, a transmission roller 60 for transmitting a driving force of the convey roller 36 to the sheet discharge roller 59, spurs 61 for aiding the sheet discharge, and a discharge tray 62. The recording sheet P can be discharged onto the discharge tray 62 by the discharge roller 59 and the spurs 61 without deteriorating the image recorded on the recording sheet.

The cleaning portion 16 comprises a pump 63 for cleaning the recording head 49, a cap 65 for preventing the drying of the recording head 49, and a drive switching arm 66 for switching the driving force from the convey roller 36 between the sheet supply portion 11 and the pump 63. Other than the sheet supplying operation and the cleaning operation, the drive switching arm 66 is positioned as shown in FIG. 1. In this case, since a planetary gear (not shown) which can be rotated around a roller shaft of the convey roller 36 is fixed at a predetermined position, the driving force from the convey roller 36 is not transmitted to both the sheet supply portion 11 and the pump 63. When the drive switching arm 66 is shifted to a direction shown by the arrow A by shifting the carriage 50, the planetary gear is shifted in response to the normal or reverse rotation of the convey roller 36. When the convey roller is rotated normally, the driving force is transmitted to the sheet supply portion, and when the convey roller is rotated reversely, the driving force is transmitted to the pump 63.

Further, the LF motor 47 for driving the convey roller 36 and the carriage motor 53 for driving the carriage 50 may be stepping motors which can be rotated by a predetermined angle in response to signals sent from drivers (not shown).

Next, a sheet conveying apparatus in this recording apparatus will be explained with reference to FIGS. 2 to 4.

In the illustrated embodiment, each pinch roller 37 has a length of 50 mm, and five pinch rollers are used so that an urging force can be applied to substantially the whole maximum width (of about 270 mm) of the recording sheet. The pinch rollers 37 are mounted on the pinch roller holder 39 so that they can smoothly rotated. The pinch roller springs 40 are positioned at corresponding portions 39*b* of pinch roller supporting portions 39*a* disposed at both ends of the pinch rollers 37, and each spring applies a force of about 400 gf to the pinch roller holder 39.

The convey roller 36 has a metal shaft portion 36*a*, and an EPDM rubber portion (high friction member) 36*b* fitted around the shaft. A gear 70 for transmitting the driving force from the convey motor 47 to the convey roller 36 and a gear 71 for transmitting the driving force to the planetary gear mounted on the drive switching arm 66 are press-fitted on the shaft portion 36*a* of the convey roller 36. The pinch roller holder 39 is rotatably received in holes (not shown) formed in the upper guide 45 via a chassis 3. The other end of each pinch roller spring is supported by a corresponding spring receiving portion of the upper guide 45.

In this condition, on the basis of the urging forces of the pinch roller springs 40, the ends of each pinch roller are biased by the pinch roller supporting portions 39*a*, with the result that the pinch rollers 37 are abutted against the rubber portion 36*b* of the convey roller 36 so that the recording sheet P pinched between the convey roller 36 and the pinch rollers 37 can be conveyed by the high friction conveying force.

Figure 3:
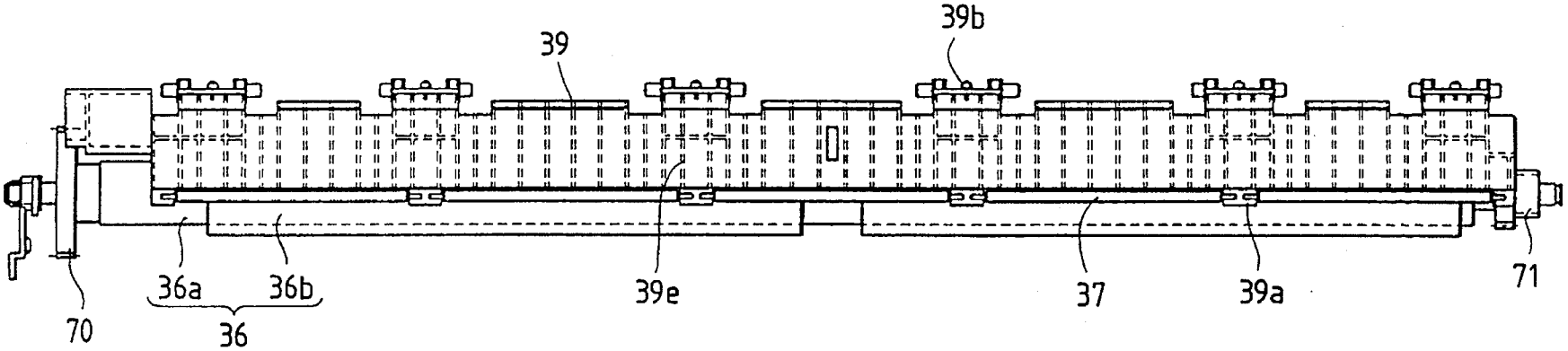
FIG. 3 is a plan view of the sheet conveying mechanism.
Figure 4:
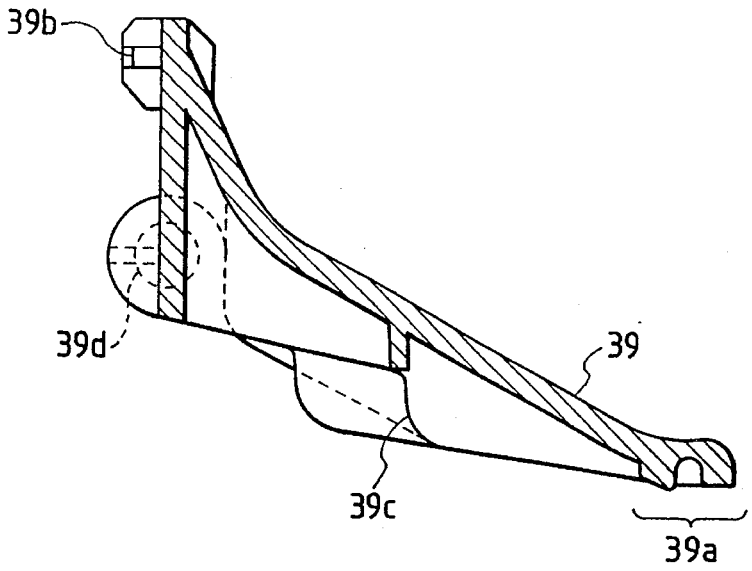
FIG. 4 is a side sectional view of a pinch roller holder.

As shown in FIGS. 3 and 4, the rigidity of the pinch holder 39 in the sheet conveying direction is increased and the rigidity of the holder in a direction perpendicular to the sheet conveying direction is positively decreased, by providing longitudinal ribs 39*e* on the holder. As a result, the lateral camber and torsion generated in the manufacture of the pinch roller holder 39 can be removed very easily by applying the above-mentioned urging forces. In the illustrated embodiment, although the camber amount of the pinch roller holder before assembling is about 20 mm at the most, only by applying the force of about 40 gf to each spring acting point 39*b*, all of five pinch rollers 37 can be abutted against the rubber portion 36*b* of the convey roller. That is, only about 10% of the spring force is used to correct the camber, and the other spring force (90% or more) can be used to urge the recording sheet.

Figure 5:
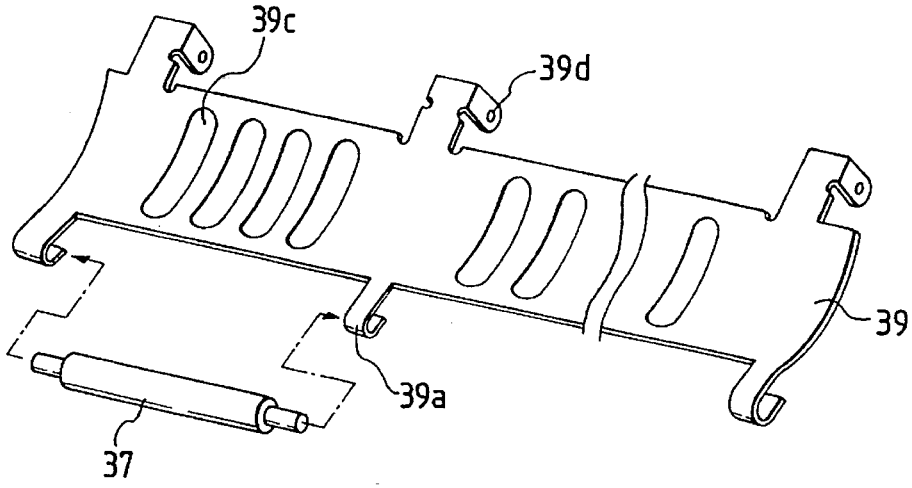
FIG. 5 is a perspective view showing an alteration of the pinch roller holder.

An alteration of the pinch rollers will be explained with reference to FIG. 5.

In this alteration, the pinch roller holder 39 is formed from a spring metal plate. A plurality of slits 39*c* are formed in the holder along the sheet conveying direction to decrease the rigidity of the holder in the direction perpendicular to the sheet conveying direction, thereby achieving the effect same as the aforementioned one. The reference numeral 39*a* denotes a pinch roller supporting portion, and 39*d* denotes a fitting hole for receiving the pinch roller.

Figure 6:
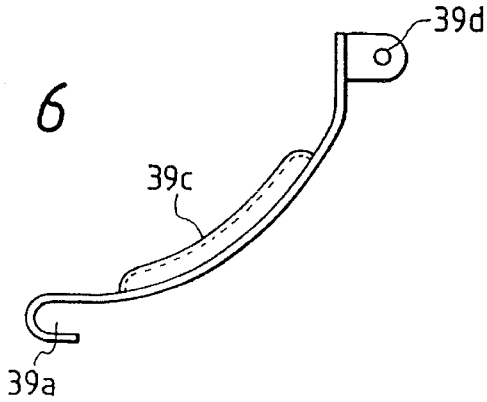
FIG. 6 is a side sectional view showing another alteration of the pinch roller holder.

Incidentally, in this alteration, the slits 39*c* may be protruded as shown in FIG. 6 (by drawing) so that the longitudinal rigidity and the widthwise rigidity of the holder can be changed. Further, without ribs, slits or drawing, the longitudinal rigidity and the widthwise rigidity of the holder may be changed by forming the holder with anisotropy material.

As mentioned above, according to the illustrated embodiment, since substantially the whole width of the sheet can be urged by the pinch rollers, the floating of the sheet can easily be prevented. Particularly, in an ink jet printer, it is possible to prevent the floating of the recording surface of the recording sheet due to the wetting of the sheet by the discharged ink, thereby preventing the deterioration of the recording quality. Further, since the rigidity of the pinch roller holder in the sheet conveying direction is increased and the rigidity of the holder in the direciton perpendicular to the sheet conveying direction is decreased, the camber and torsion of the holder can be corrected by the small force, and the pinch rollers can be uniformly urged against the convey roller by substantially net of the spring forces. Consequently, the uniform conveying force can be applied to the sheet, thereby conveying the sheet with high accuracy. Further, since the pinch roller holder is formed as one piece, it is possible to reduce the part cost and assembling cost. In addition, by reducing the number of parts, since the increase in reliability can be expected, it is possible to provide a sheet conveying apparatus which is cheap and reliable.

FIGS. 7 to 23 show a recording apparatus integrally incorporating an automatic sheet supplying device, according to a second embodiment of the present invention. The recording apparatus comprises a sheet supply portion 111, a sheet conveying portion 112, a sheet discharge portion, a carriage portion 115, and a cleaning portion 116. First of all, constructions and operations of these portions will be briefly described.

Figure 7:
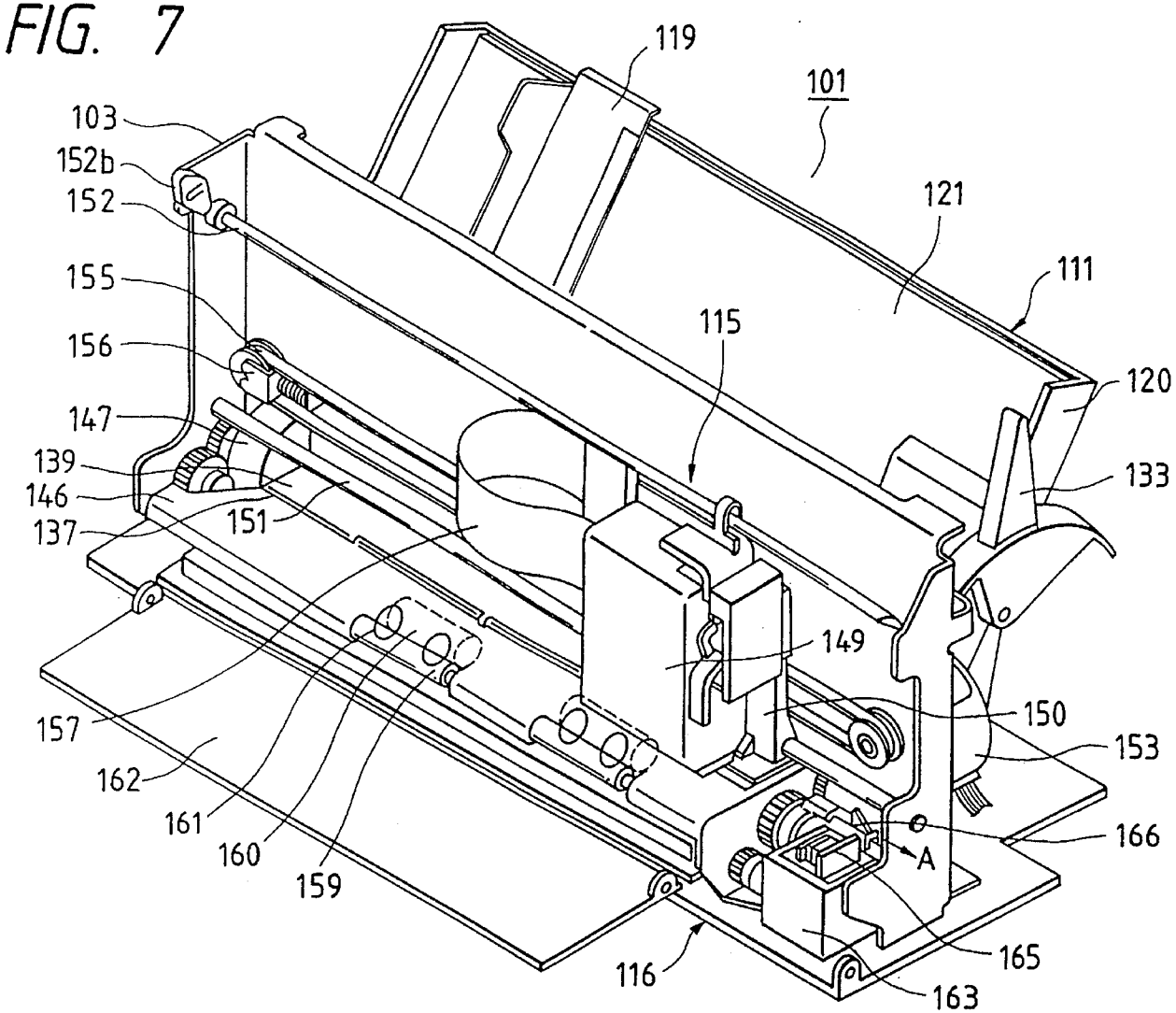
FIG. 7 is a perspective view of a recording apparatus according to a second embodiment of the present invention.
Figure 8:
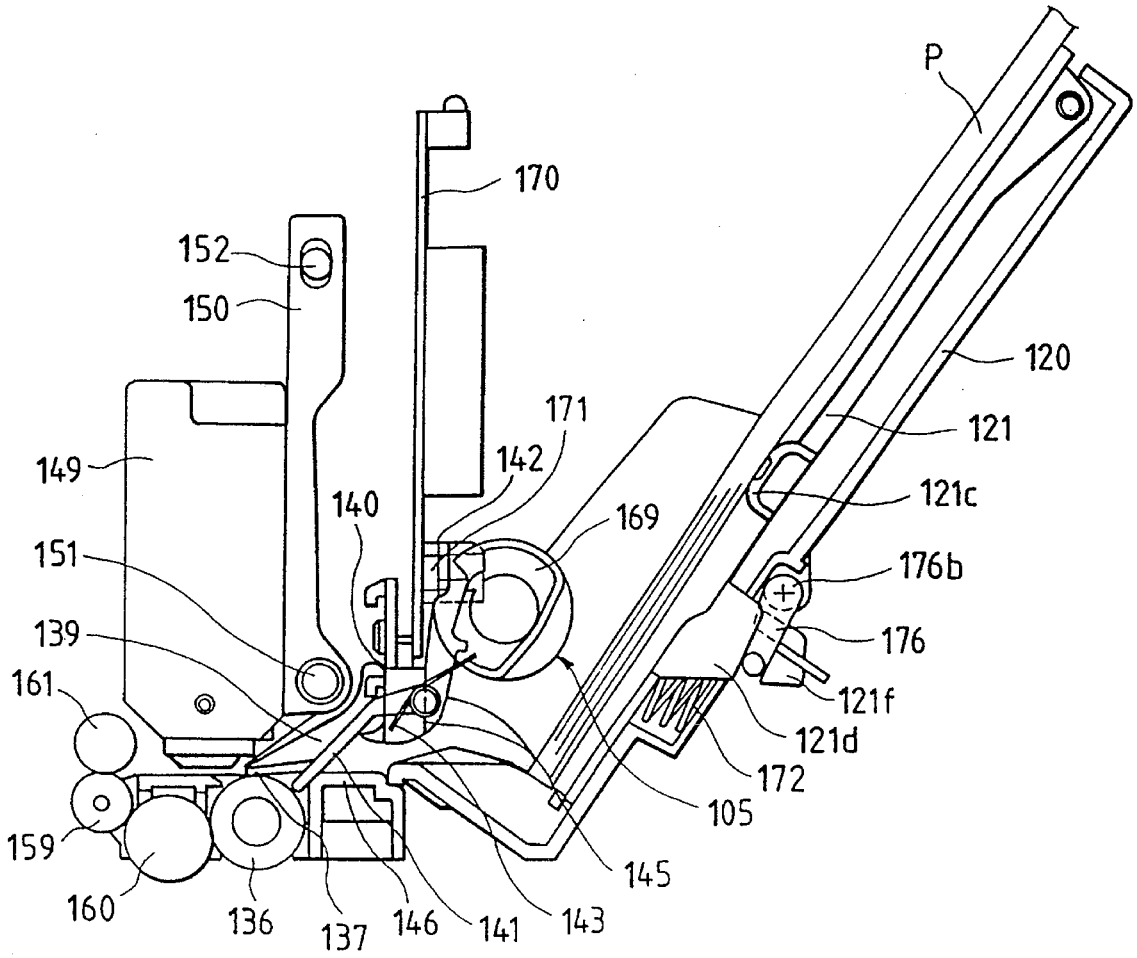
FIG. 8 is a side sectional view of the recording apparatus.
Figure 9:
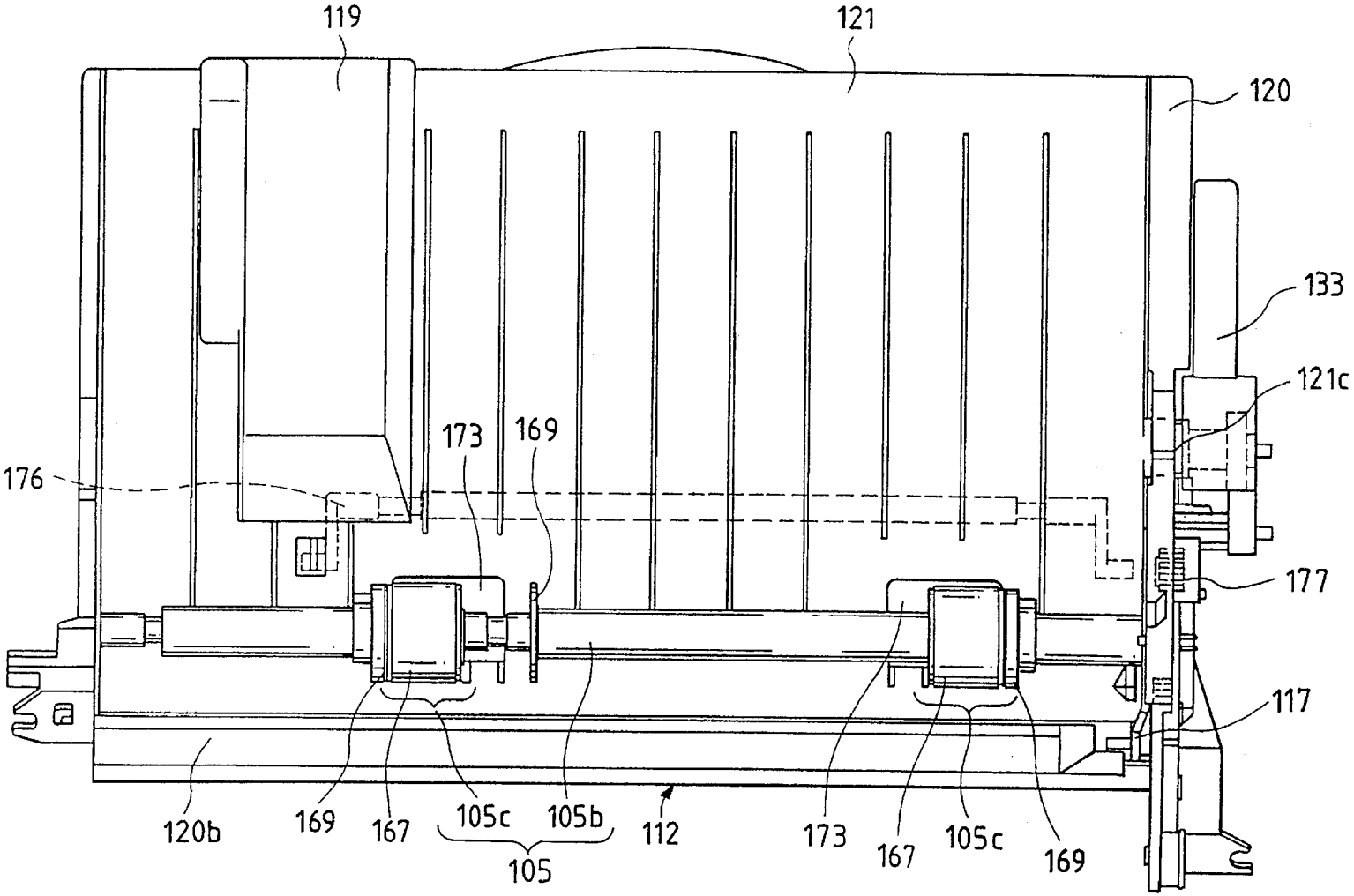
FIG. 9 is a front view of the recording apparatus.
Figure 10:
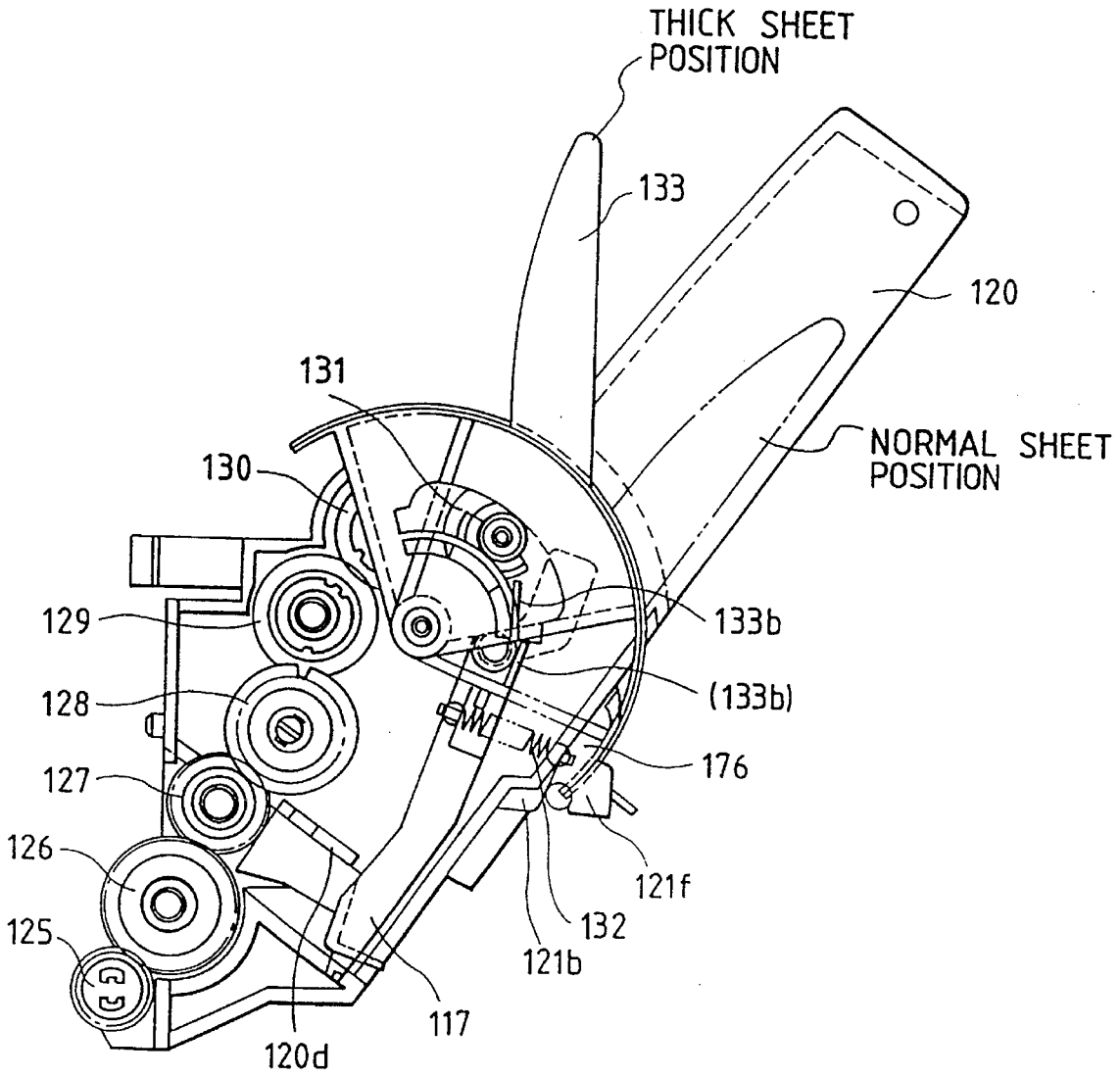
FIG. 10 is a side view of the recording apparatus.

FIG. 7 is a perspective view showing a whole construction of the recording apparatus, FIG. 8 is a sectional view showing the whole construction of the recording apparatus, FIG. 9 is a front view of a sheet supply portion, and FIG. 10 is a side view of the sheet supply portion.

The sheet supply portion 111 is attached to a body of the recording apparatus at an angle of 30–60 degrees. A recording sheet P fed from the sheet supply portion is recorded, and then is discharged horizontally. The sheet supply portion 111 comprises a sheet supply roller 105, a separating claw 117, a movable side guide 119, a base 120, a pressure plate 121, pressure plate springs 122, drive gears 125–130, a release cam 131, a claw spring 132, an operation lever 133, and a releasing cam 135. Normally, since the pressure plate 121 is lowered to a position shown in FIG. 8 by the release cam 13, the recording sheet P is spaced apart from the sheet supply roller 105.

In a condition that the recording sheets P are set, a driving force from a convey roller 136 is transmitted to the sheet supply roller 105 and the rlease cam 131 via the drive gears 125–130. When the release cam 131 is separated from the pressure plate 121, the latter is lifted, with the result that the recording sheet P is contacted with the sheet supply roller 105. The recording sheets P are picked up by the rotation of the sheet supply roller 105 and then are separated one by one by the separating claw 117. The separated recording sheet P is sent to the sheet conveying portion. The sheet supply roller 105 and the release cam are rotated by one revolution until the recording sheet is sent to the sheet conveying portion 112. Thereafter, the pressure plate 121 is lowered and separated from the sheet supply roller 105 so that the driving force of the sheet supply roller 105 is not transmitted to the recording sheet on the pressure plate, thus restoring the initial condition.

The sheet conveying portion 112 comprises a convey roller 136, pinch rollers 137, a pinch roller guide 139, pinch roller springs 140, a PE sensor lever 141, a PE sensor 142, a PE sensor spring 143, an upper guide 145 and a platen 146. The recording sheet P sent to the sheet conveying portion 112 is conveyed to a nip between the convey roller 136 and the pinch rollers 137 while being guided by the platen 146, pinch roller guide 139 and upper guide 145. The PE sensor lever 141 is disposed in front of the paired rollers 136,137 to detect a tip end (leading end) of the recording sheet P, thereby determining a printing position on the recording sheet P. The pinch rollers 137 are urged against the convey roller 136 by biasing the pinch roller guide 139 by the pinch roller spring 140, thereby generating a conveying force for the recording sheet P. The recording sheet P conveyed by the paired rollers 136, 137 is advanced on and along the platen 146 by rotating the paired rollers 136, 137 by an LF motor 147; meanwhile, an image is recorded on the recording sheet by a recording head 149 on the basis of desired image information. The recording head 149 is integrally formed with an ink tank to provide an easily exchangeable ink jet recording head unit. The recording head 149 includes electrothermal converters so that the ink is discharged from an ink discharge opening by utilizing the change in pressure due to growth and contraction of a bubble caused by the film boiling generated when thermal energy is applied to the selected converter.

The carriage portion 115 comprises a carriage 150 to which the recording head 149 is attached, a guide shaft 151 for reciprocally guiding the carriage in a direction perpendicular to a sheet conveying direction, a guide 152 for holding a rear end of the carriage and for maintaining a gap between the recording head and the recording sheet, a timing belt 155 for transmitting a driving force of a carriage motor 153 to the carriage 150, idle pulleys 156 for supporting the timing belt 155, and a flexible cable 157 for transmitting a head drive signal from an electric substrate to the recording head 149. The image is recorded on the recording sheet P being conveyed on the platen 146 by scanning the recording head 149 mounted on the carriage 150.

The sheet discharge portion comprises a sheet discharge roller 159, a transmission roller 160 for transmitting a driving force of the convey roller 136 to the sheet discharge roller 159, spurs 161 for aiding the sheet discharge, and a discharge tray 162. The recording sheet P can be discharged onto the discharge tray 162 by the discharge roller 159 and the spurs 161 without deteriorating the image recorded on the recording sheet.

The cleaning portion 116 comprises a pump 163 for cleaning the recording head 149, a cap 165 for preventing the drying of the recording head 149, and a drive switching arm 166 for switching the driving force from the convey roller 136 between the sheet supply portion 111 and the pump 163. Other than the sheet supplying operation and the cleaning operation, the drive switching arm 166 is positioned as shown in FIG. 7. In this case, since a planetary gear (not shown) which can be rotated around a roller shaft of the convey roller 136 is fixed at a predetermined position, the driving force from the convey roller 136 is not transmitted to both the sheet supply portion 111 and the pump 163. When the drive switching arm 166 is shifted in a direction shown by the arrow A by shifting the carriage 150, the planetary gear is shifted in response to the normal or reverse rotation of the convey roller 136. When the convey roller is rotated normally, the driving force is transmitted to the sheet supply portion, and when the convey roller is rotated reversely, the driving force is transmitted to the pump 163.

Further, the LF motor 147 for driving the convey roller 136 and the carriage motor 153 for driving the carriage 150 may be stepping motors which can be rotated by a predetermined angle in response to signals sent from drivers (not shown).

The sheet supply roller 105 includes sheet supply roller rubbers 167 attached to sheet supply roller portions, and sensor plates 169 each having a diameter smaller than that of the sheet supply roller rubber. Each sensor plate 169 has a notch so that, only when the sheet supply roller 105 and the release cam 131 are in an initial position where the pressure plate 121 is lowered as shown in FIG. 8, a roller sensor 172 comprising a photo-interrupter directly provided on an electric substrate 170 is not blocked, thus establishing the light passing condition.

By detecting the condition of the sensor plates 169, an angular position of the sheet supply roller 105 and an angular position of the release cam 131 driven in phase with the sheet supply roller 105 can be detected, thereby obtained the timing of the control of a sheet supply sequence for the recording sheet P.

Next, main elements of the sheet supply portion 105 and the sheet conveying portion 112 will be fully explained.

Figure 11:
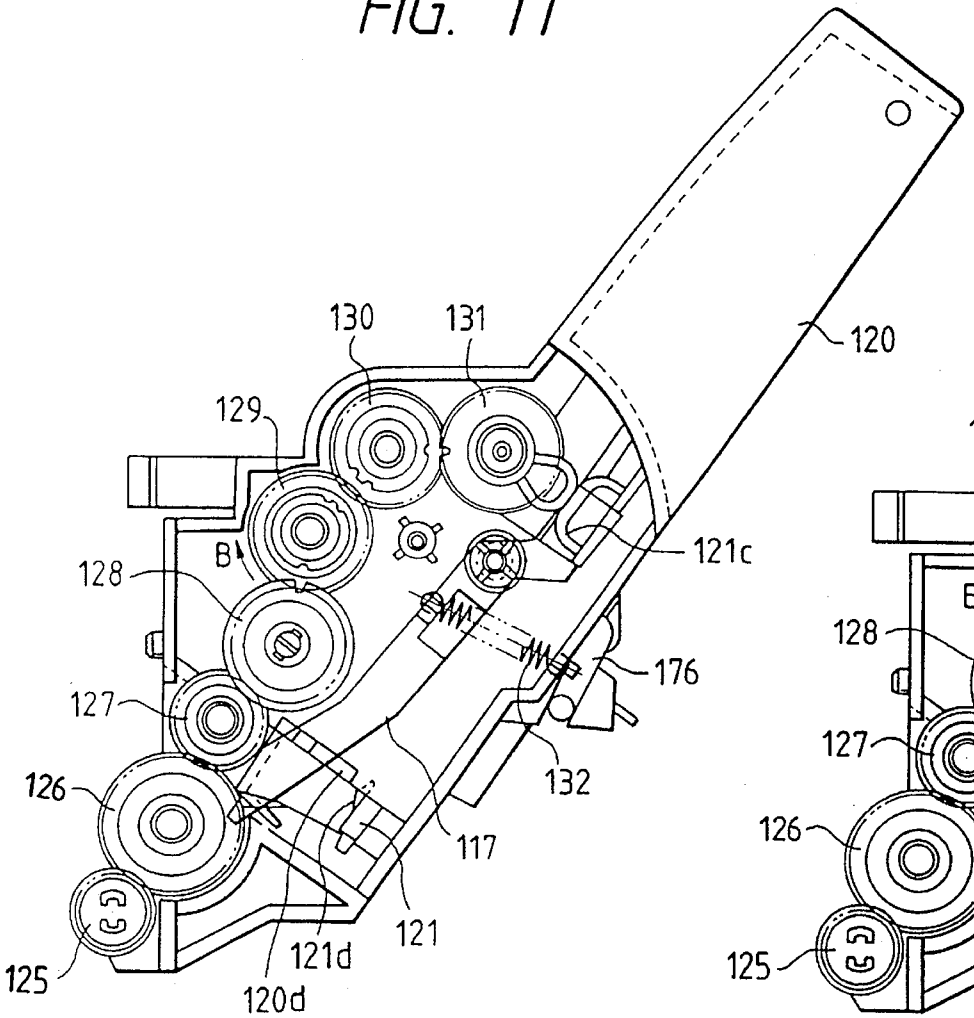

The sheet supply portion 111 is constituted as a unit wherein various elements of the sheet supply portion are mounted on the base 120. In the illustrated embodiment, the sheet supply portion 111 is of one side reference type wherein the recording sheets are set by utilizing a left side plate of the base 120 as a reference. The base 120 has a recessed portion into which the pressure plate 121 is retarded as shown in FIG. 11 and in which the pressure plate springs 122 are positioned in a confronting relation to the roller portions **105*c* of the sheet supply roller 105. The pressure plate 121 is connected to the base 120 via pressure plate pins 121*b* formed on both upper sides of the plate so that the pressure plate can be around the pins 121*b*. Separation pads 173 made of material having relatively high coefficient of friction such as artificial leather are arranged on the pressure plate 121 at position confronting to the sheet supply roller portions, thereby preventing the double-feed of the sheets when the number of sheets is decreased. Further, the movable side guide 119 can be slid to the left and right on the pressure plate 121** so that any sheets having different sizes can easily be set against the sheet reference.

Both ends of the sheet supply roller 105 are rotatably supported by the base 120. The sheet supply roller 105 a one piece molded part comprising a shaft portion **105*b* and roller portions 105*c*, and the sheet supply roller rubbers 167 are arranged around the roller portions 105*c*. Each roller portion has a semi-circular configuration. Further, auxiliary rollers 175 each having a diameter smaller than that of the sheet supply roller rubber 167 of the sheet supply roller 105 by 0.5–3 mm are arranged on outer sides of the roller portions 105*c* so that the deterioration of the image and the out-of-position of the roller portions 105*c* can be prevented by preventing the contact between the recording sheet and the roller rubbers 167** other than the sheet supplying operation.

Further, there are two roller portions **105*c*, and these roller portions are fixed on the shaft portion 105*b* and are spaced apart from the sheet reference by about 40 mm and 170 mm, respectively. Thus, a sheet of A4 size is conveyed by two roller portions 105*c*, and a post card is conveyed by the single roller portion 105*c*** near the sheet reference.

When the convey roller 136 is rotated normally by shifting the drive switching arm 166 of the cleaning portion 116 in the direction A by the carriage 150, the planetary gear (not shown) is shifted to engage with an input gear 125, thereby transmitting the driving force to the sheet supply portion. The input gear 125 transmits the driving force to a sheet supply roller gear 128 connected to the sheet supply roller 105, via idler gears 126, 127, with the result that the sheet supply roller 105 is rotated, thereby conveying the recording sheet P. Further, the sheet supply roller gear 128 transmits the driving force to the release cam 131 via a clutch gear 129 and an idler gear 130. In this case, the sheet supply roller 105 is in phase with the release cam 131 for each revoltuion so that, in the condition that the pressure plate 121 is released as shown in FIG. 8, cut-out portions of the semi-circular roller portions 105*c* of the sheet supply roller 105 are opposed to the pressure plate 121 as shown in FIG. 8. The release cam 131 is so shaped that it can release the pressure plate 121 only through 120 degrees of the cut-out portion, so that, when the cylindrical portions of the roller portions of the sheet supply roller 105 are opposed to the pressure plate 121, the release cam is contacted with the recording sheet P or the pressure plate 121 with a pressure of 200–500 grams without fail.

Further, the release cam 131 releases the pressure plate 121 by depressing a hold-down portion 121*c* of the pressure plate 121 protruded from a hole formed in the right side plate of the base 120. In this case, a pressure plate cam 176 attached to the base 120 is lowered by a cam 121*d* arranged near the hold-down portion 121*c* of the pressure plate 121, thereby rotating the pressure plate cam 176 around a center 176*b*. And, the cam 105*f* arranged at an outer side of the left roller portion 105*c* is lowered by the pressure plate cam 176. In this way, even when the hold-down portion 121*c* arranged at the end of the pressure plate 121 is lowered, the pressure plate 121 is not inclined with respect to the base 120 to be maintained substantially horizontally. A clutch spring 177 is arranged within the clutch gear 129 so that, when the gear is rotated in a direction shown by the arrow B in FIG. 11, the clutch spring is tightened, thereby preventing the reverse rotation of the gear. Thus, since the sheet supply roller is not rotated by the resiliency of the recording sheet P during the registration, it is possible to effect the good registration.

The separating claw 117 can be rotated around a center 117*b* and is normally urged against the recording sheet P or the pressure plate 121 with a force of 20–100 grams. The separating claw 117 serves to separate so-called normal recording sheets, and is disposed in the proximity of the sheet reference as shown in FIG. 9. The separating claw has a triangular configuration covering a corner of the recording sheet P.

When the recording sheets P are subjected to the resistance from the triangular portion of the separating claw 117, they can be separated one by one. A claw slide spring 135 is mounted on a shaft to which the separating claw 117 is attached near the root of the separating claw 117, thereby biasing the separating claw 117 toward a direction that the separating claw is disengaged from the shaft. The release cam 131 has a claw cam 131*b* for rotating the separating claw 117, as well as the cam portion for releasing the pressure plate 121. The operation lever 133 has two position, i.e., (1) normal sheet feed position and (2) thick sheet feed position, which positions are spaced apart from each other by an angle of 20–50 degrees.

Figure 13:
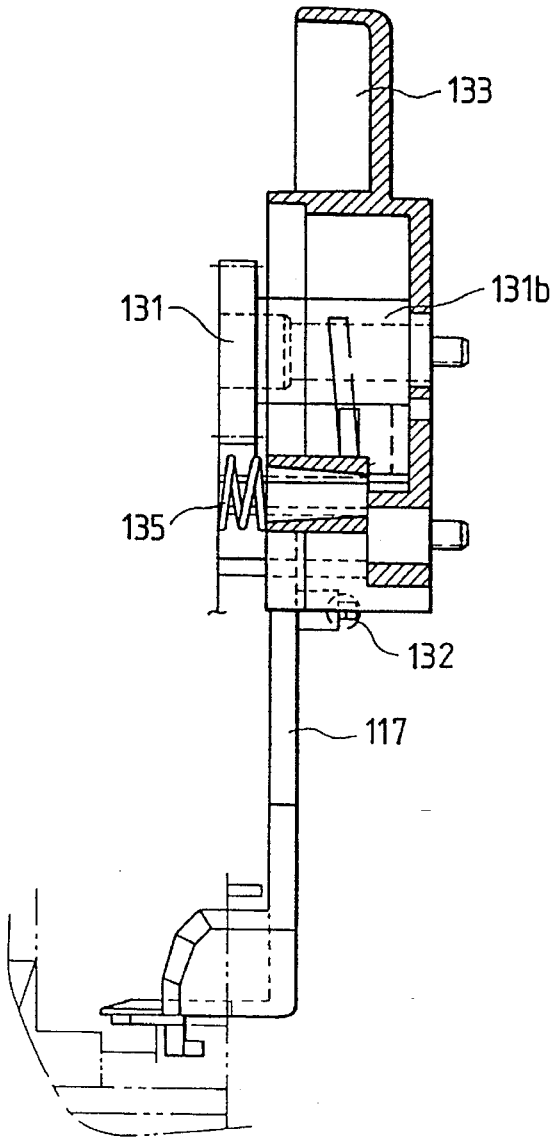
FIGS. 13 and 14 are views showing an operation of an operation lever.

In the normal sheet feed position, the separating claw 117 is rotated by a cam 133*b* of the operation lever 133 and, at the same time, is urged axially as shown in FIG. 13 until the claw cam 131*b* of the release cam 131 can act on the separating claw. In this case, in the release condition that the pressure plate 121 is lowered by the release cam 131, the separating claw 117 is rotated by the claw cam 131*b*, thereby shifting the triangular portion upwardly as shown in FIG. 11. Thus, normally, in the release condition, the recording sheets P can be set as they are. When the sheet supplying operation is started by rotating the sheet supply roller 105, the driving force is transmitted to the release cam 131 to release the release condition, with the result that the pressure plate 121 is urged against the sheet supply roller 105 with the interposition of the recording sheets P. In this case, since the claw cam 131*b* which has urged the separating claw 117 upwardly is also rotated, the separating claw 117 is urged against the recording sheet P, thereby establishing the sheet separation permitting condition.

Figure 12:
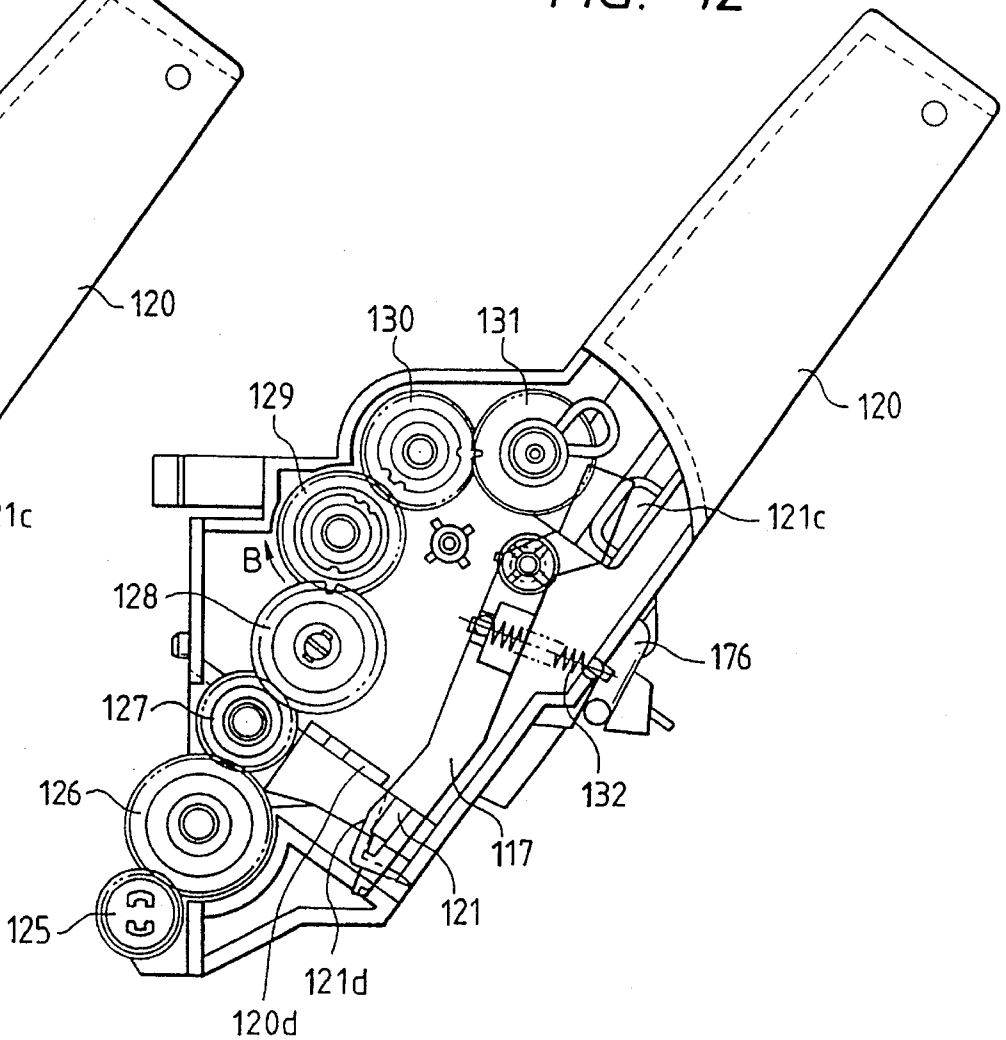
FIGS. 11 and 12 are side sectional views of the recording apparatus.
Figure 14:
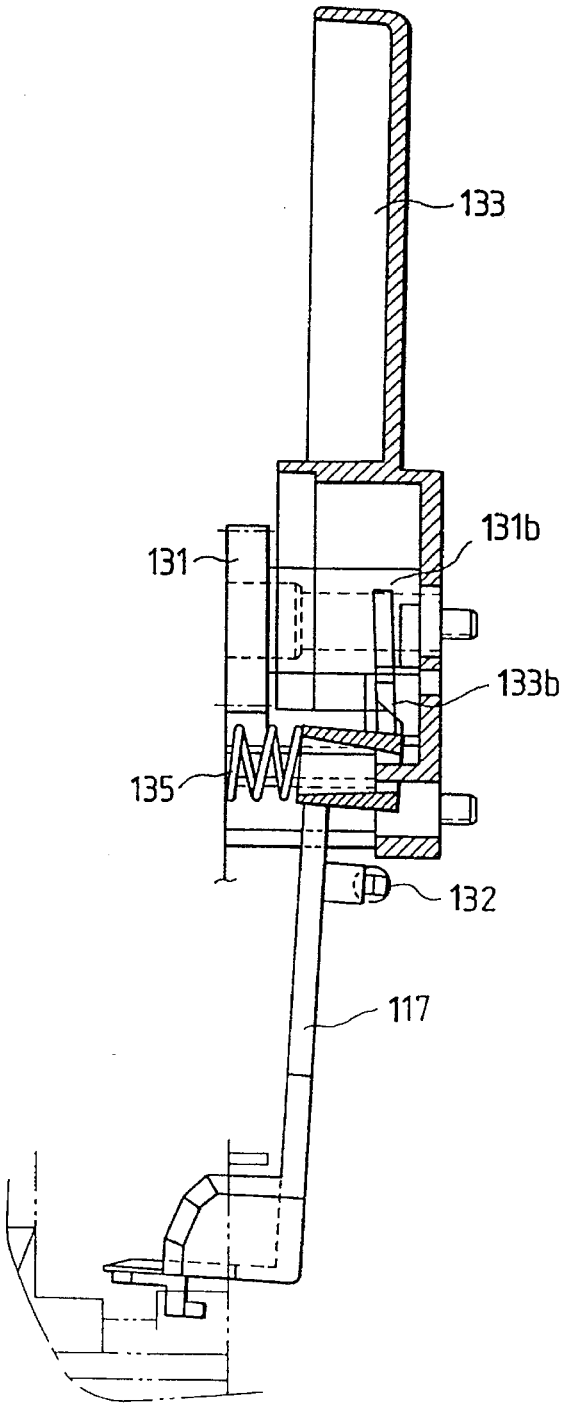

In the thick sheet feed position, the cam 133*b* of the operation lever 133 is in a position that it releases the separating claw 117. Thus, the separating claw 117 is pushed out of the shaft by the claw slide spring 135 as shown in FIG. 14. In this position, since the separating claw 117 is not subjected to the action of the claw cam 131*b* of the release cam 131, as shown in FIG. 12, the separating claw is biased toward the pressure plate 121. In this case, a projection 121*d* is provided on the pressure plate at a position above the position on which the separating claw 117 acts, so that, when the thick sheets are set, the thick sheet is prevented from entering beneath the separating claw 117. In this way, the thick sheets (other than the normal sheet) can be separated one by one by preventing the sheets from being caught by the separating claw and by abutting the sheets against a lower guide portion 120*b* of the base 120 (to utilize the resistance from the lower guide).

Further, a manual sheet insertion is effected in the thick sheet feed position. In the thick sheet feed position that the thick sheets are set, the recording sheet P is manually inserted in the nip between the pinch rollers 137 and the convey roller 136. In this case, the registration of the recording sheet P is effected after one or two seconds when the PE sensor 142 is turned ON by the passing of the sheet through the PE sensor lever 141, thereby establishing the print signal waiting condition.

In the normal sheet feed position that the normal sheets are set, if the recording sheet P is inserted manually, since the inserted recording sheet is caught by the separating claw 117. Accordingly, the thick sheet feed position is selected so that the separating claw 117 is biased toward the normal sheet, thereby permitting the insertion of the manual sheet in the nip between the pinch rollers 137 and the convey roller 136 as mentioned above. After the insertion of the manual sheet, the same sequence as mentioned above is effected.

Figure 15:
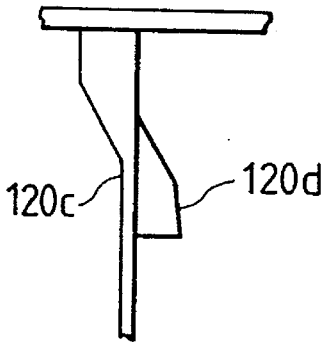
FIG. 15 is a plan view of a separating claw.
Figure 16:
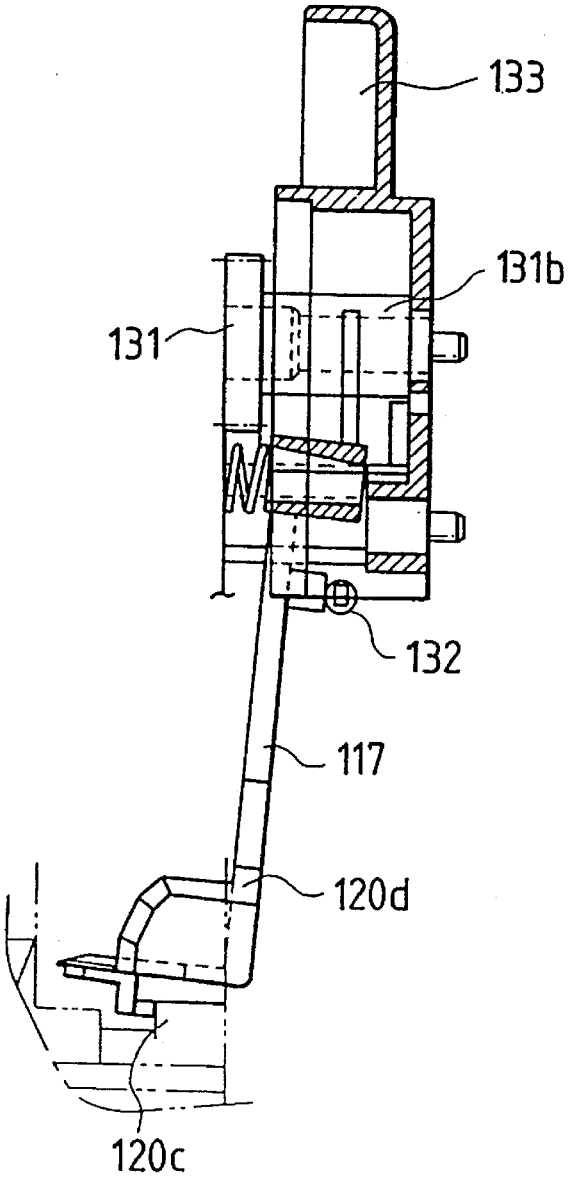
FIG. 16 is a view showing an operation of the separating claw.

In this case, in some cases, the tip end of the recording sheet reaches up to the lower guide portion 120*b*. In this condition, if the normal sheet feed position is switched to the thick sheet feed position for the manual sheet insertion to urge the separation claw 117 toward the pressure plate 121, particularly when the remaining number of sheets is few, the corners of the recording sheets P are curled by the biasing force of the separating claw 117. As a result, when the normal catching amount of 3–5 mm which is optimum to the separation of the recording sheet is selected, the recording sheets P are escaped from the separating claw 117, with the result that, even when the normal sheet feed position is restored, since the sheets are escaped from the separating claw, the double-feed of the sheets will occur. To avoid this, in the illustrated embodiment, the hole of the separating claw 117 is tapered to permit the rocking of the claw, so that, when the separating claw 117 is biased toward the pressure plate 121 and is lowered as shown in FIG. 16 by guide portions 120*c*, 120*d* of the base 120 as shown in FIG. 15, the catching amount of the separating claw for the recording sheet becomes 8–10 mm. In this way, the escape of the sheets from the separating claw 117 can be prevented.

Incidentally, the above-mentioned gears (excluding sheet supply roller shaft 179), separating claw 117 and operation lever 130 are arranged on a shaft supported by the right side plate of the base 120 and can be rotated around the shaft. The sheet conveying portion 112 comprises the convey roller 136, pinch rollers 137, pinch roller guide 139, pinch roller springs 140, PE sensor lever 141, PE sensor 142 PE sensor spring 143, upper guide 145 and platen 146. These elements are attached to a chassis 103 individually or as a unit. The recording sheet P fed from the sheet supply portion 111 is conveyed to the nip between the convey roller 136 and the pinch rollers 137 while being guided by the platen 146, pinch roller guide 139 and upper guide 145. The PE sensor lever 141 is provided on the upper guide 145 in front of the paired rollers 136, 137. The PE sensor lever 141 can be rotated around a shaft attached to the upper guide 145 so that, when there is no recording sheet, the lever is biased by the PE sensor spring 143 to a position that the PE sensor 142 is blocked by the lever. The PE sensor 142 comprises an optical sensor such as a photo-interrupter directly attached to the electric substrate 170. When the recording sheet P is supplied, since the PE sensor lever 141 is rotated by the sheet, the PE sensor is changed from light blocking condition to the light passing condition. In this way, the tip and of the recording sheet P can be detected.

Figure 17:
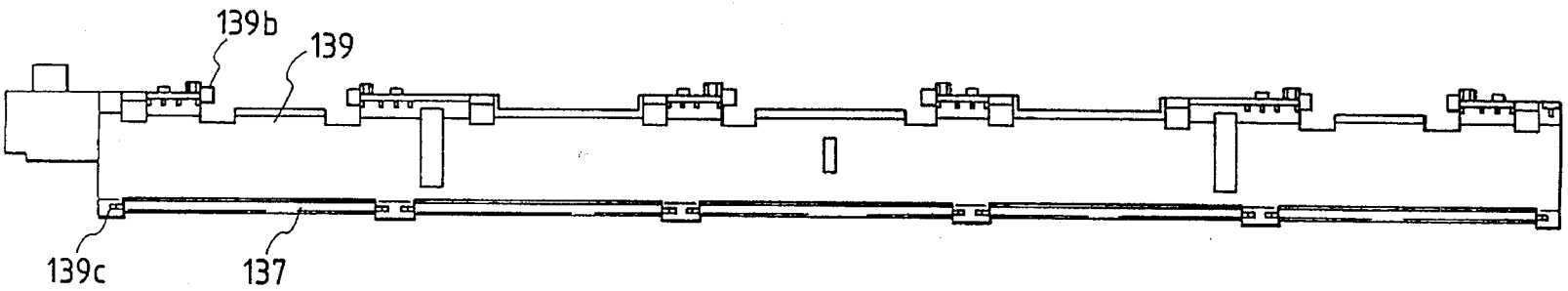
FIG. 17 is a plan view of a pinch roller portion.

The convey roller 136 serves to position the platen 146 and is attached to the chassis. The pinch rollers 137 are rotatably mounted on the pinch roller guide 139, and a rotary shaft **139*b* of the guide can be rotatably received in bearings 145*b* of the upper guide 145. The pinch rollers are urged against the convey roller spring 136 by the pinch roller springs 140 rested on the upper guide 145, thereby generating the conveying force for the recording sheet P. As shown in FIG. 17, each pinch roller has a length of 30–50 mm and a diameter of 2–5 mm, and a plurality of pinch rollers are urged against the convey roller with both ends of the pinch rollers being held by the pinch roller guide 139. In this way, by using the pinch rollers having the small diameter, a distance between a position where the recording sheet P is held by the paired rollers 136, 137 and a printing position for the recording head 149 can be reduced, with the result that the gap between the recording head 149** and the recording sheet P can be uniform and small, thereby obtaining the good image.

Figure 18:
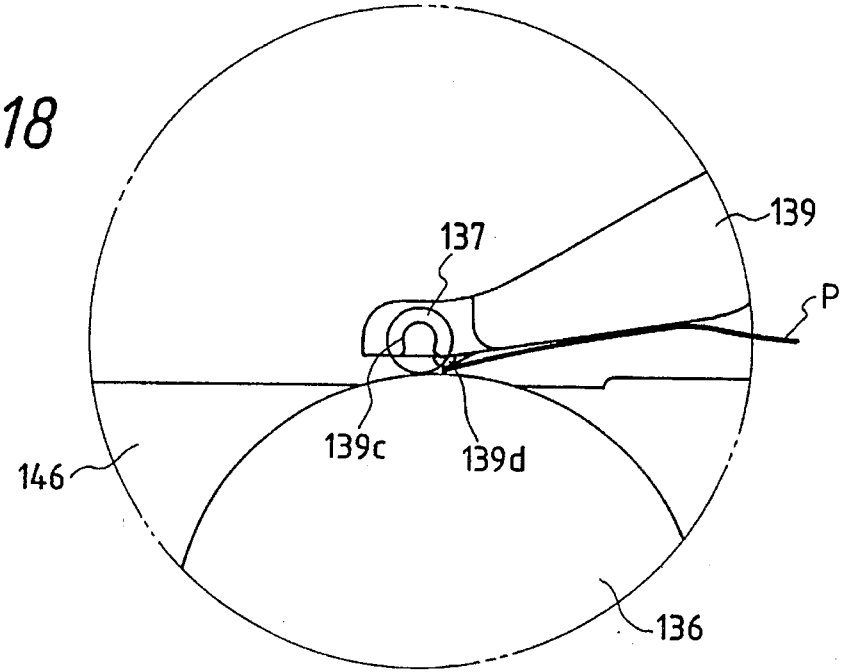
FIG. 18 is a cross-sectional view of a sheet conveying portion.

Further, as shown in FIG. 18, protruded portions **139*d* each of which has a gap of 0.2–0.5 mm with respect to the convey roller 136 are provided on the pinch roller guide 139 at an upstream side of the bearing portions 139*c* for holding both ends of the pinch rollers 137 in the sheet conveying direction. The protruded portions 139*d*** do not relate to the conveyance and registration of the normal sheet. However, regarding an envelope and the like, the protruded portions act as mentioned below to improve the conveying and registering ability.

(1) When the small diameter pinch rollers as mentioned above are used, since the nip between the convey roller and the pinch roller becomes small, the thick sheet such as the envelope cannot be properly pinched by the nip between the paired rollers 137. However, since the protruded portions provide auxiliary nip to create the conveying force, even the thick sheet can be pinched by the nip properly.

(2) During the registration, the normal sheet is registered by the paired rollers 136, 137. However, the registration of the thick sheet such as the envelope is effected by the protruded portions **139*d*, and, thus, the sheet is returned back to these protruded portions. Accordingly, the protruded portions can also act as guides, thereby preventing the tip end of the envelope from entering above the pinch rollers 137**.

The recording sheet P sent by the paired rollers 136, 137 is advanced along and on the platen 146 by rotating the paired rollers 136, 137 by the LF motor 147; meanwhile an image is recorded on the recording sheet P by the recording head 149 in response to predetermined image information.

Next, the operation and control of the sheet supply portion will be explained.

Figures 19, 19A:
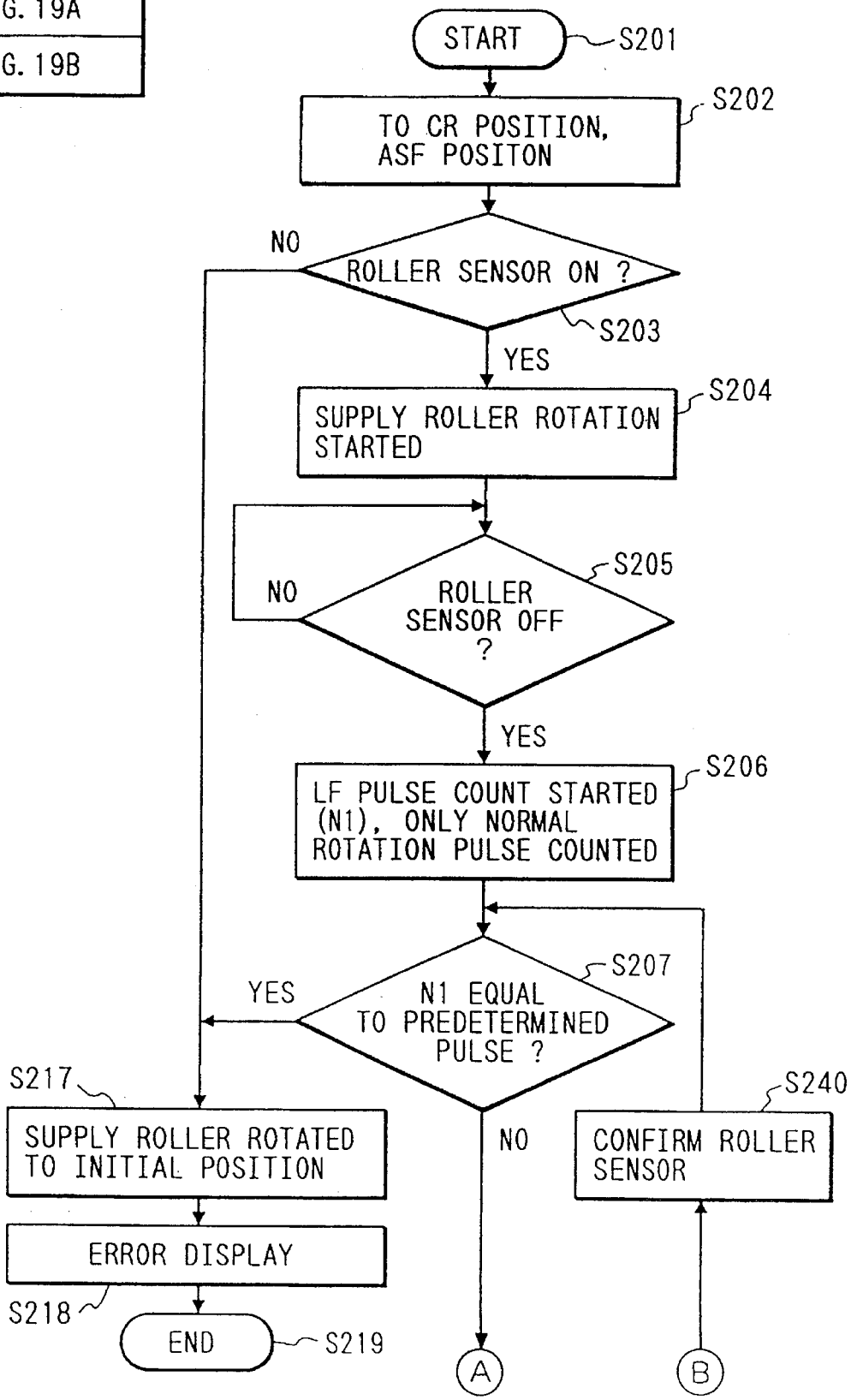
FIGS. 19, 19A and 19B are flow charts showing the control of the recording apparatus.
Figure 19B:
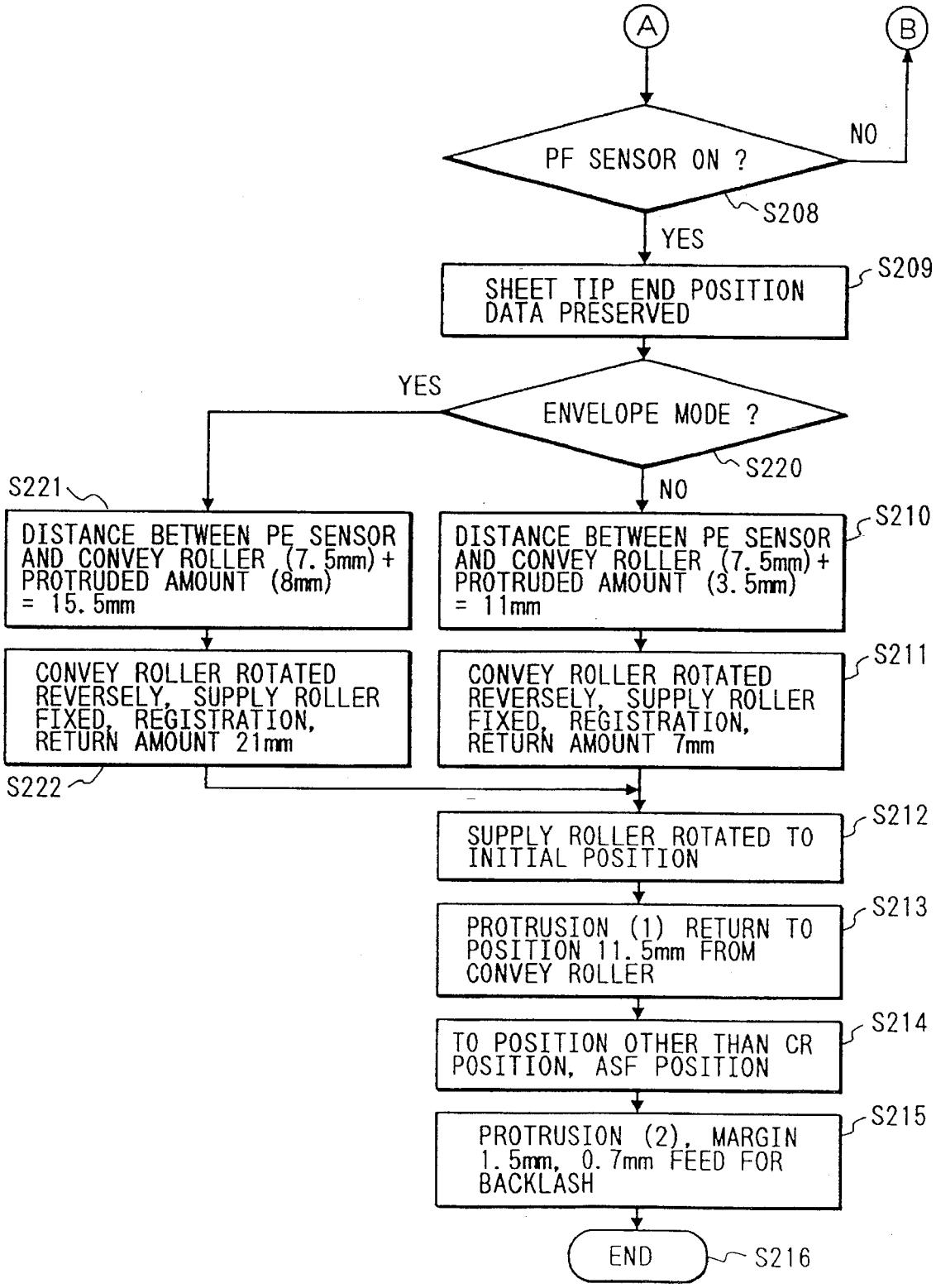
Figure 20A:
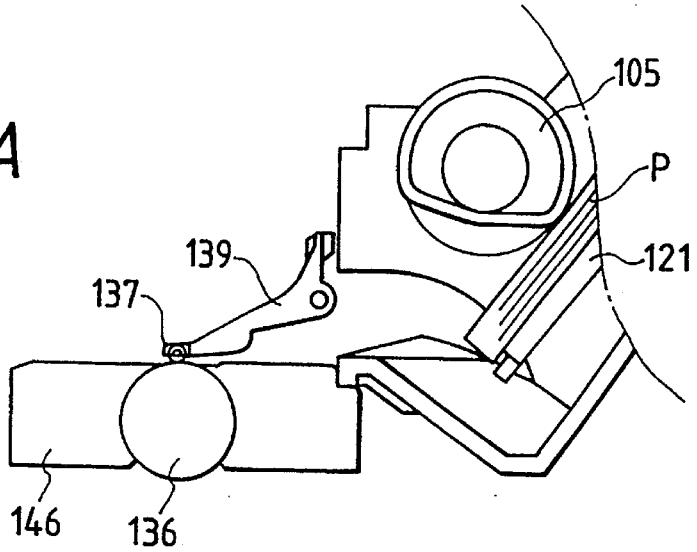
FIGS. 20A to 20C, 21A to 21C and 22 are side views of the sheet conveying portion for explaining a sheet conveying operation.
Figure 20B:
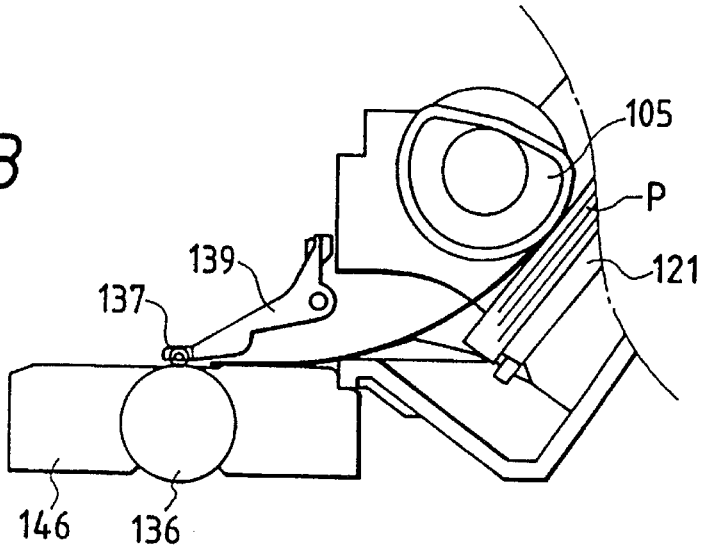
Figure 20C:
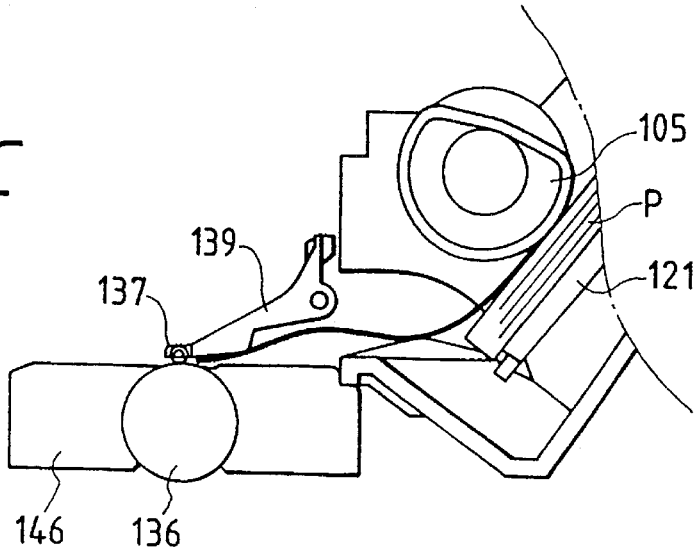
Figure 21A:
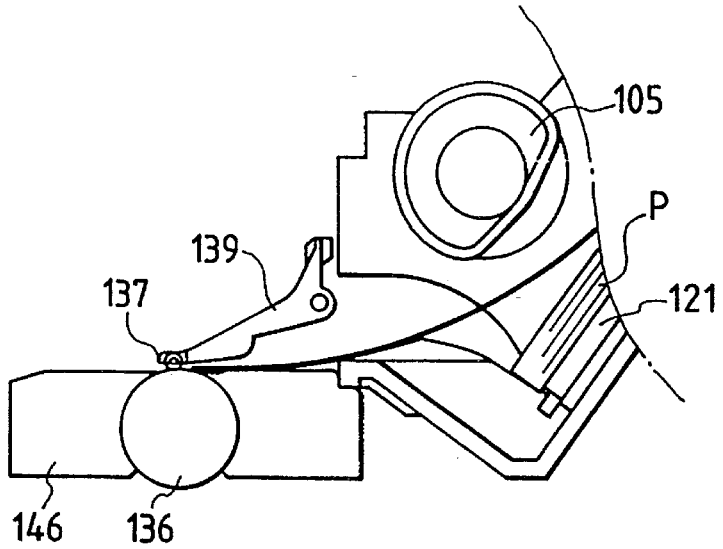
Figure 21B:
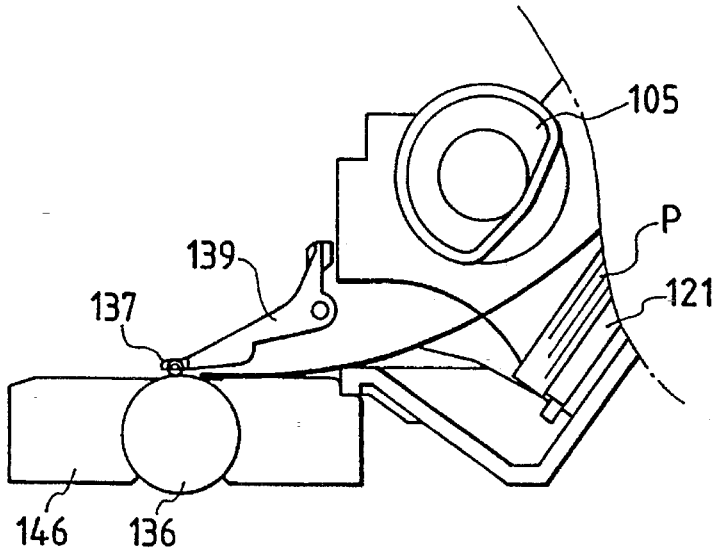
Figure 21C:
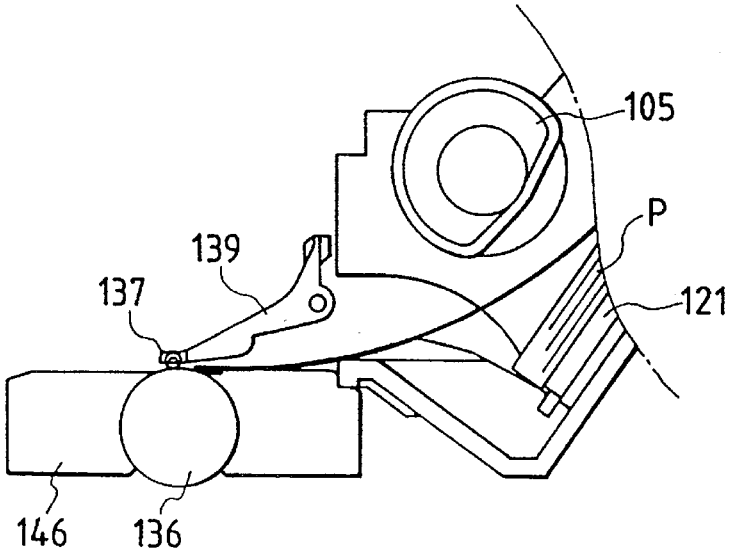
Figure 22:
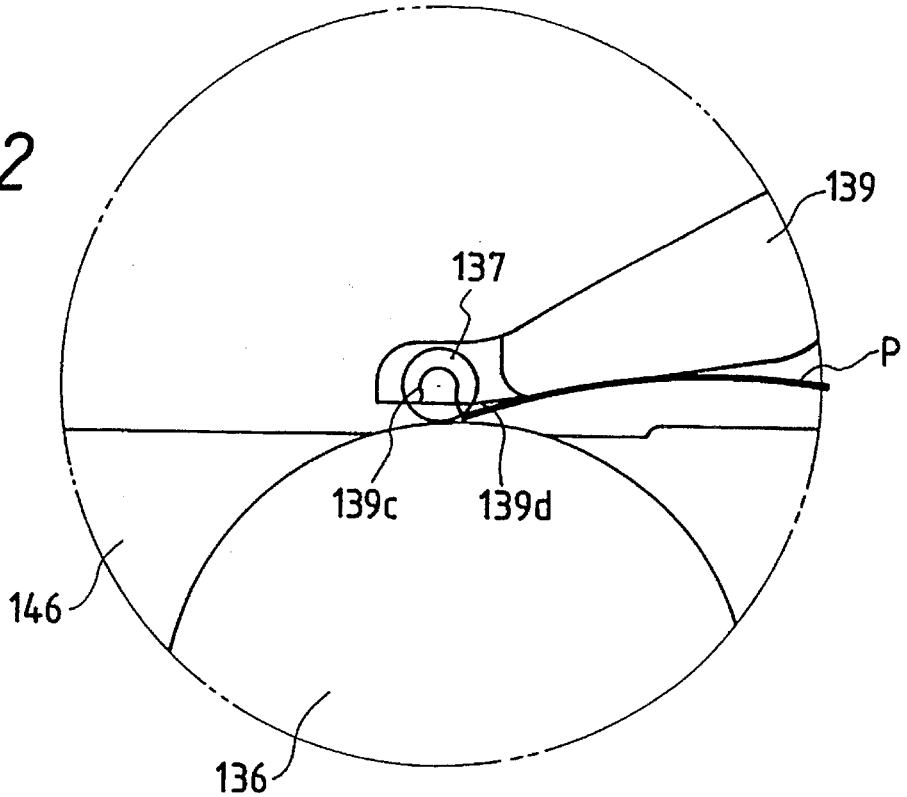

FIGS. 19A and 19B are flow charts showing the whole controls, FIGS. 20A to 20C and 21A to 21C show the sheet supplying operation in a normal sheet mode, and FIG. 22 shows an envelope mode. An operator selects the sheet supply mode via the operation lever 133, sheet-to-sheet distance adjusting lever **152*b*** and operation switch (not shown), thus determining the normal sheet mode or envelope mode.

First of all, the sheet supplying operation in the normal sheet mode will be described. In a step S201, the sheet supply is started. In a step S202, in response to the sheet supply start signal, the carriage 150 is shifted to shift the drive switching arm 166 to permit the transmission of the driving force to the sheet supply portion (AS position). Then, in a step S203, the condition of the roller sensor 152 is judged; if the sheet supply roller 105 is in the initial position, the program goes to a step S204, whereas if not, the program goes to a step S217. When the sheet supply roller 105 is in the initial position, the sheet supply roller 105 is rotated in the step S204, and, in a step S205, the edge of the sensor plate 169 is detected. By counting (N1) the number of drive pulses of the LF motor 147 after the detection, the angular position of the sheet supply roller is controlled correctly, thereby obtaining the high accurate control. When the sheet supply roller 105 is rotated by about 60 degrees to confront the cylindrical portions of the semi-circular roller portions to the recording sheet P, the release cam 131 synchronous with the sheet supply roller 105 releases the pressure plate 121, with the result that the sheet supply roller rubbers 167 are urged against the recording sheet by the pressure plate springs 172, thereby creating the conveying force for the recording sheet (FIG. 20A). In steps S207, S208, the tip end of the recording sheet being conveyed is detected by the PE sensor 142. If the tip end of the recording sheet is not detected by the PE sensor 142 even after the sheet supply roller 105 is rotated by a predetermined amount, since there is no recording sheet on the pressure plate 121 or the slip exceeds a predetermined level, the program goes to the step S217, where the sheet supply roller 105 is rotated to the initial position and then is stopped there. Then, the error is displayed (step S218), and the program is ended (step S219).

When the PE sensor 142 is turned ON before the sheet supply roller is rotated by the predetermined amount, a sheet tip end position data N2 is sought at an angular position of the sheet supply roller 105 where the PE sensor 142 is turned ON, and this data is stored (step S209). In a step S220, it is checked whether the normal sheet mode is selected or the envelope mode is selected; if the normal sheet mode, the program goes to a step S210 (if the envelope mode, the program goes to a step S221). Then, in the step S210, the recording sheet P is conveyed to the nip between the convey roller 136 and the pinch rollers 137, thereby effecting the protrusion for the registration. In the illustrated embodiment, since the recording sheet is conveyed by 7.5 mm (up to the nip) after the PE sensor 142 is turned ON and the protruded amount of 3.5 mm is required, the recording sheet is conveyed by 11 mm in total and then is stopped (FIG. 20B).

In the step S211, the convey roller 136 is rotated reversely to leave the tip end of the recording sheet P from the nip between the convey roller 136 and the pinch rollers 137. To this end, the recording sheet is fed back by about 7 mm (including the protrudes amount and light blocking amount). In this case, since the planetary gear (not shown) for transmitting the driving force to the sheet supply roller 105 is separated from the input gear 125, the reverse driving force is not transmitted to the sheet supply roller 105. Further, since the sheet supply roller 105 is urged against the pressure plate 121 with the interposition of the recording sheets P, when the recording sheet P is fed back by the convey roller 136 for the registration of the recording sheet P, a force (by the resiliency of the sheet) for rotating the sheet supply roller 105 reversely acts on the sheet supply roller. However, due to the presence of the clutch gear 129, the clutch spring is tightened to fix the sheet supply roller 105, with the result that a loop is formed in the recording sheet due to the resiliency of the sheet, thereby effecting the registration of the tip end of the sheet (FIG. 20C).

Then, in the step S212, the sheet supply roller 105 is rotated to the initial position where the cut-out portions of the semi-circular roller portions of the sheet supply roller 105 are opposed to the recording sheet P. During this rotation, the release cam 131 lowers the hold-down portion 121*c* of the pressure plate 121 again, thereby releasing the pressure plate 121 again (FIG. 21A). In this condition, the tip end of the recording sheet P is protruded from the nozzles of the recording head 149 greater than a predetermined margin of 1.5 mm. Accordingly, as shown in a step S213, in the illustrated embodiment, the recording sheet is fed back by 11.5 mm position from the nip between the convey roller 136 and the pinch rollers 137 by rotating the convey roller 136 reversely (FIG. 21B). The returning amount can be calculated from the sheet tip end position data N2. In a step S214, the carriage 150 is shifted to shift the drive switching arm 166 so that the driving force is not transmitted to the sheet supply portion. Then, in a step S215, the convey roller 136 is rotated normally to remove the backlash of gears, thereby feeding the recording sheet by 0.7 mm. In this way, the margin of 1.5 mm is obtained between the nozzle of the recording head 149 and the tip end of the recording sheet P (FIG. 21C). In the step S220, if the envelope mode is selected, the program goes to steps S221, S222. In this case, the protruded amount and the returning amount differ from those in the steps S210, S211 and are increased to 8 mm (from 3.5 mm) and to 21 mm (from 7 mm), respectively. Since the registration of thick sheet such as the envelope is difficult, by increasing the protruded amount and the returning amount, the registering ability is enhanced. Further since the loop is positively formed in the recording sheet P during the registration, the sheet can be effectively pinched between the paired rollers 136, 137. FIG. 22 shows the position of the envelope after the registration (returned back to the paired rollers 136, 137) (corresponding to FIG. 20C). FIG. 18 shows the position of the normal sheet. The other operations are the same as those in the normal sheet mode.

Figure 23:
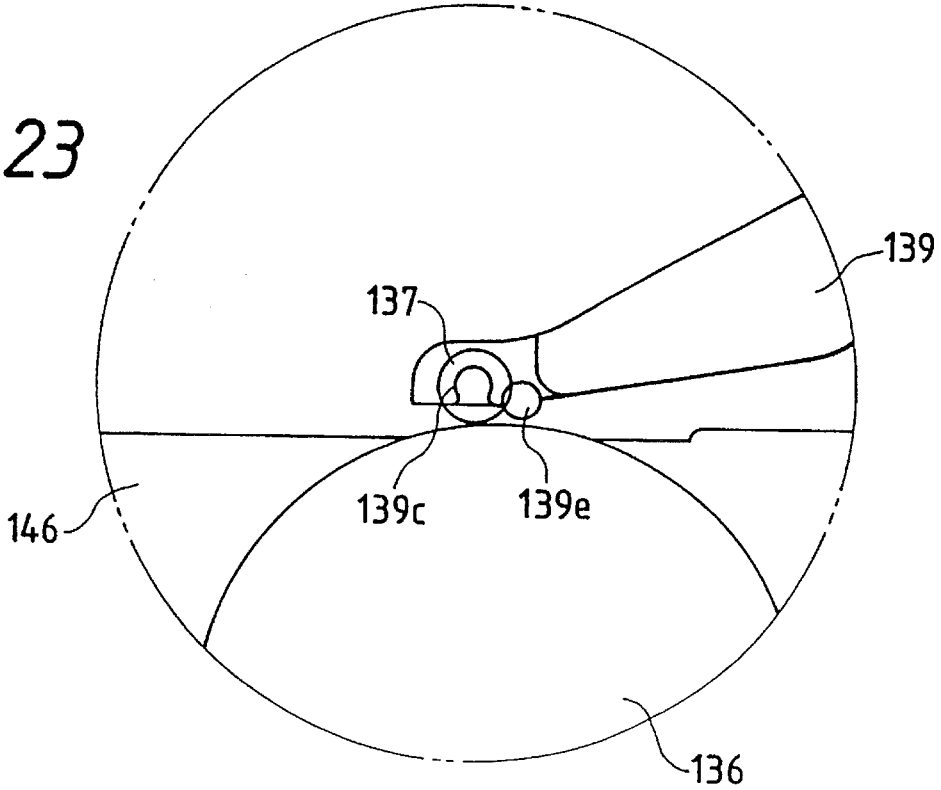
FIG. 23 is a side view showing an alteration of the sheet conveying portion.

In the above-mentioned embodiment, while the protruded portions 139*d* were integrally formed with the pinch roller guide 139, as shown in FIG. 23, in place of the protruded portions, rotary members 139*e* may be used. The rotary members 139*e* are rotatably held by holder portions 139*f* of the pinch roller guide 139 and each has a gad of 0.2–0.5 mm with respect to the convey roller 136. In this case, since the sliding resistance between the recording sheet P and the rotary members 139*e* is small, the recording sheet can be conveyed further smoothly. The other construction are the same as those in the aforementioned embodiment.

Figure 25:
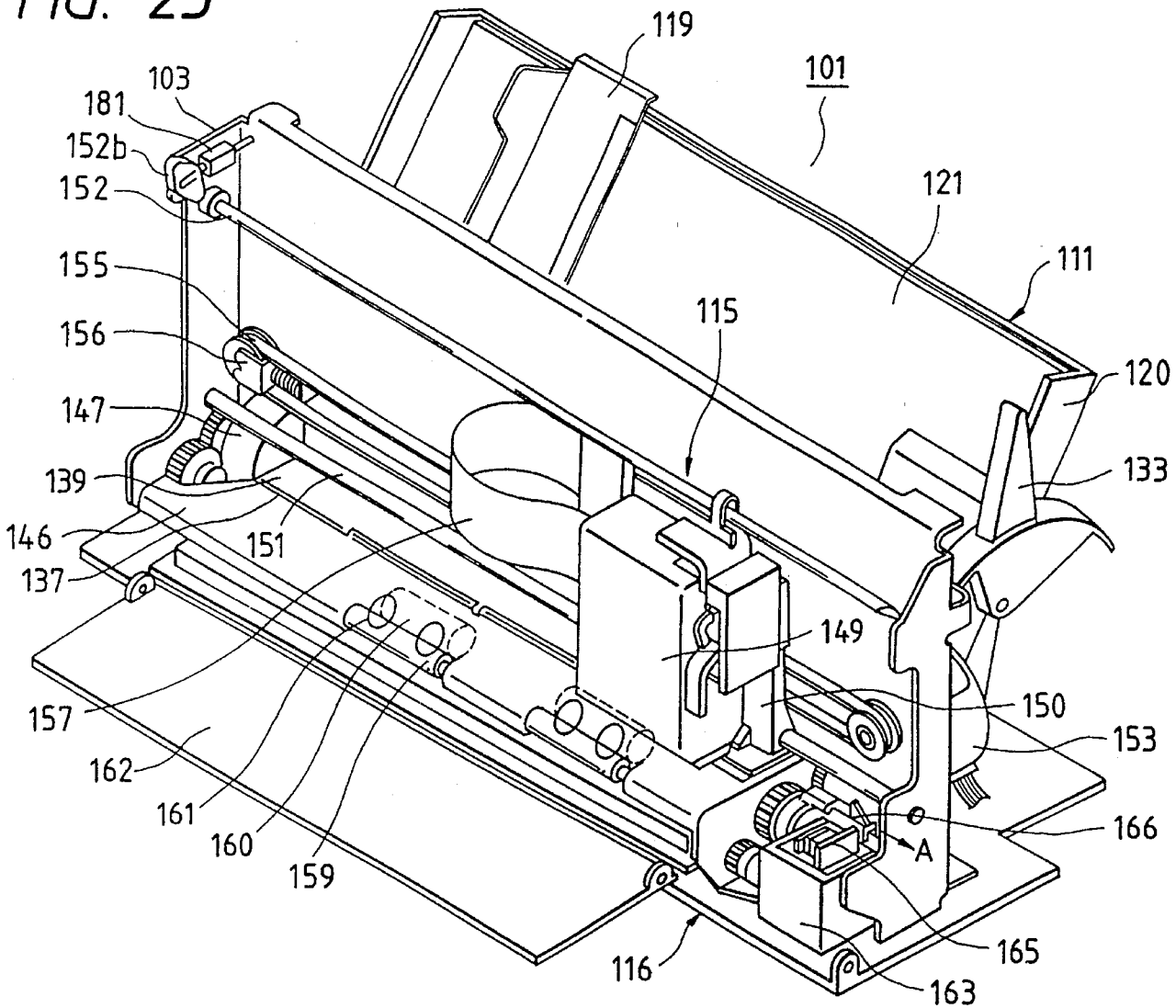
FIG. 25 is a perspective view of the recording apparatus.
Figure 24:
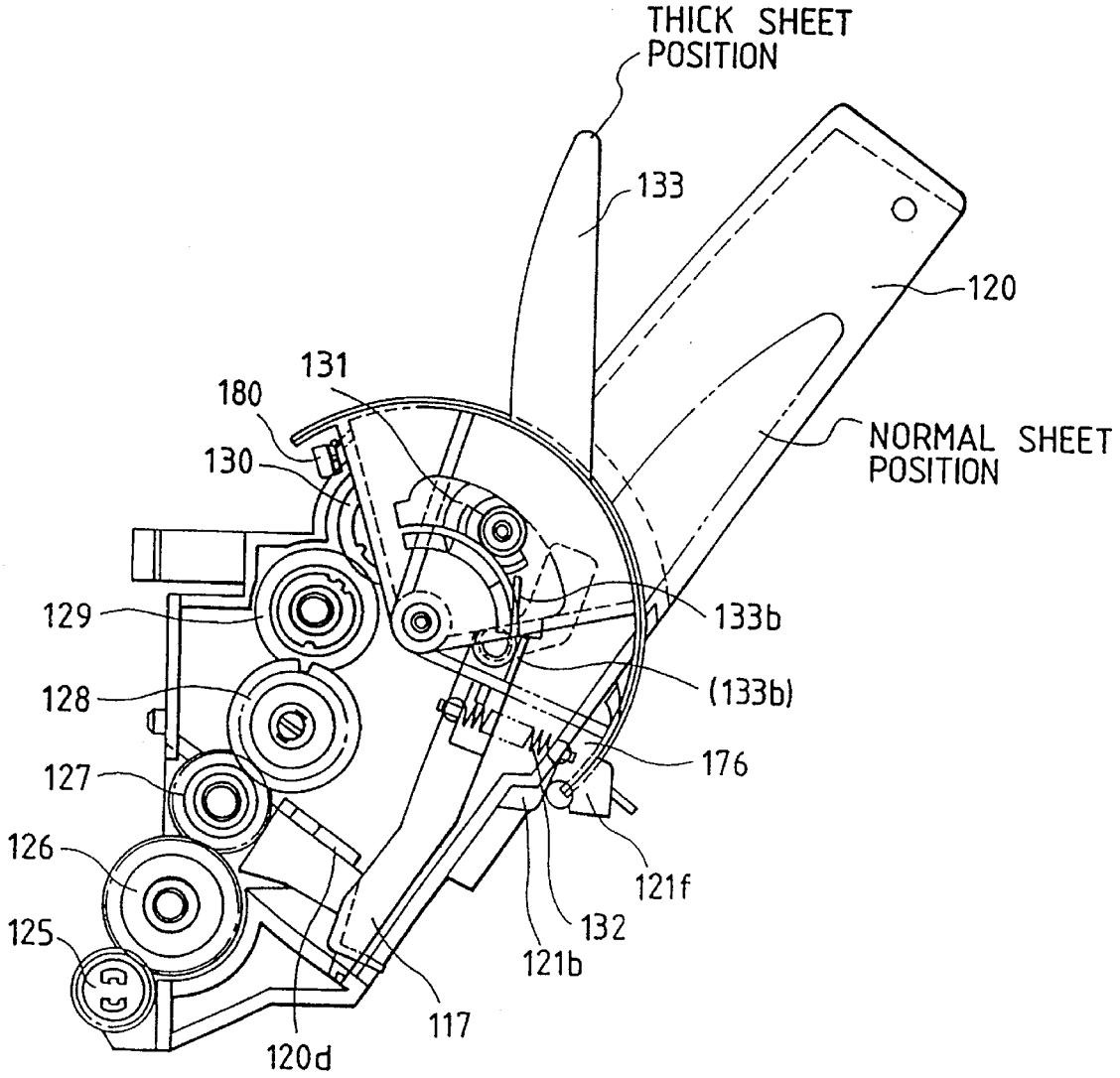
FIG. 24 is a side view of a recording apparatus according to a third embodiment of the present invention.

In the above-mentioned embodiments, in the switching between the normal sheet mode and the envelope mode, while the switching of the sheet supply mode by means of the operation switch, the switching of the separating type by means of the operation lever 133 and the switching of the sheet-to-sheet distance by means of the sheet-to-sheet distance adjusting lever 152*b* were required, when all of the switching can be effected by switching the operation lever 133, the troublesome of the operator's manipulation can be relieved. That is, as shown in FIG. 24, an operation lever position detecting means 180 such as a microswitch is arranged in a moving path of the operation lever 133, thereby detecting the thick sheet position. The detecting means 180 is connected to the electric substrate 170 so that, on the basis of the detection signal, the sheet supply mode is changed and the protruded amount and the returning amount for the registration are determined. Further, as shown in FIG. 25, a drive means 181 such as a solenoid for driving the sheet-to-sheet distance adjusting lever 152*b* is driven by means of the electric substrate 170, thereby rotating the guide 152 to automatically change the sheet-to-sheet distance. The other constructions are the same as those in the aforementioned embodiments.

As mentioned above, according to the illustrated embodiments, the following advantages can be obtained.

(1) Even when the small diameter pinch rollers are used as the conveying means for the recording sheet, the thick sheet such as envelope can be conveyed in the same manner as the normal sheet, and the poor protrusion and the poor registration of the sheet due to the poor pinching of the pinch rollers can be prevented.

(2) By using the rotary members in place of the protruded portions on the pinch roller guide, the sliding resistance can be reduced, thereby conveying the sheet more smoothly.

(3) By detecting the position of the operation lever, since the sheet supply mode, and the gap between the recording head and the recording sheet can be changed automatically, the operability can be further improved.

What is claimed is:

1. A sheet conveying apparatus, comprising:

feeding means for feeding a sheet;

a rotary member for conveying the sheet fed by said feeding means;

pressing means for nipping the sheet by cooperating with said rotary member; and controlling means for controlling rotation of said rotary member in a normal direction or a reverse direction, wherein said rotary member is rotated in the normal direction to convey the sheet fed by said feeding means in a forward direction by nipping the sheet in cooperation with said pressing member, then said rotary member is rotated in the reverse direction to convey the sheet in a backward direction until a leading end of the sheet nipped by a nipping portion between said rotary member and said pressing means is released to thereby cause the sheet to bend between the nipping portion and said feeding means with the leading of sheet being abutted against the nipping portion, and then said rotary member is rotated in the normal direction to convey the sheet in the forward direction, said controlling means controlling said rotary member in correspondence with a first mode for a first sheet thickness and a second mode for a second sheet thickness thicker than the first sheet thickness, so that in the first mode said rotary member starts conveyance of the sheet in the reverse direction after conveying the sheet by a first predetermined amount, and in the second mode said rotary member starts conveyance of the sheet in the reverse direction after conveying the sheet by a second predetermined amount larger than the first predetermined amount.

2. A sheet conveying apparatus according to claim 1, wherein said controlling means changes a reverse rotation amount of said rotary member, corresponding to the conveying amount of the sheet by said rotary member until said rotary member starts the reverse rotation.

3. A sheet conveying apparatus according to claim 1, further comprising a switch for changing the conveying amount of sheet until said rotary member starts the reverse rotation.

4. A sheet conveying apparatus according to claim 1, wherein said pressing means has a pressing rotary member for nipping the sheet by cooperating with said rotary member.

5. A sheet conveying apparatus according to claim 4, wherein said pressing means has a nipping member disposed upstream of said pressing rotary member for nipping the sheet by cooperating with said rotary member.

6. A sheet conveying apparatus according to claim 5, wherein said rotary member is disposed to keep a gap relative to said nipping member.

7. A sheet conveying apparatus according to claim 6, wherein a first sheet is bent between said nipping portion and said supply means with the leading end being abutted against the nipping portion between said rotary member and said pressing rotary member.

8. A sheet conveying apparatus according to claim 7, wherein upon conveying of a second sheet thicker than the first sheet, the sheet is bent between the nipping portion and said feeding means with the leading end being abutted against the nipping portion between said rotary member and said nipping member.

9. A sheet conveying apparatus according to claim 8, wherein said controlling means changes a conveying amount of the sheet by said rotary member until said rotary member starts the reverse rotation.

10. A sheet conveying apparatus according to claim 9, wherein said controlling means controls the sheet conveying amount by said rotary member until said rotary member starts the rotation of reverse direction larger for the first mode than the second mode.

11. A sheet conveying apparatus according to claim 10, wherein in the first mode the bending is formed with the leading end being abutted against the nipping portion between said rotary member and said pressing means; and in the second mode the bending is formed with the leading end being abutted against the nipping portion between said rotary member and said nipping member.

12. A sheet conveying apparatus according to claim 1, further comprising recording means for effecting a recording to the sheet.

13. A sheet conveying apparatus according to claim 12, wherein said recording means effects the recording by discharging an ink.

14. A sheet conveying apparatus according to claim 13, wherein said recording means discharges an ink droplet by thermal energy.

15. A sheet conveying apparatus, comprising:

feeding means for feeding a sheet;

a rotary member for conveying the sheet fed by said feeding means; and pressing means for nipping the sheet by cooperating with said rotary member, said pressing means having a pressing rotary member for nipping the sheet by cooperating with said rotary member and a nipping member disposed upstream of the pressing rotary member for nipping the sheet by cooperating with said rotary member, said rotary member being disposed to keep a predetermined gap relative to said nipping member;

wherein upon conveying of a first sheet, the first sheet is fed by said feeding means to said rotary member with a leading end thereof being abutted against a first nip between said rotary member and said pressing rotary member to thereby form a bending of the first sheet between the first nipping portion and said feeding means; and upon conveying of a second sheet thicker than the first sheet, the second sheet is fed by said feeding means to said rotary member with the leading end being abutted against a second nipping portion between said rotary member and said nipping member to thereby form a bending of the second sheet between the second nipping portion and said feeding means.

16. A sheet conveying apparatus according to claim 15, further comprising recording means for effecting a recording to the sheet fed by said feeding means.

17. A sheet conveying apparatus according to claim 16, wherein said recording means effects the recording by discharging an ink.

18. A sheet conveying apparatus according to claim 17, wherein said recording means discharges the ink by thermal energy.

* * * * *

UNITED STATES PATENT AND TRADEMARK OFFICE

CERTIFICATE OF CORRECTION

PATENT NO. : 5,620,174
DATED : April 15, 1997
INVENTOR(S) : Masahiro TANIGURO, et al.

It is certified that error appears in the above-indentified patent and that said Letters Patent is hereby corrected as shown below:

COLUMN 2

Line 31, delete "met hod" and insert therefor --method--.

COLUMN 5

Line 10, after "can", insert --be--.

COLUMN 8

Line 32, delete "12lb" and insert therefor --121b--.

COLUMN 11

Line 23, delete "and" and insert therefor --end--.

COLUMN 13

Line 5, delete "protrudes" and insert therefor --protruded--;
Line 62, delete "gad" and insert therefor --gap--;
Line 66, delete "construction" and insert therefor --constructions--.

Signed and Sealed this

Eighteenth Day of November 1997

*Attest:*

Bruce Lehman

BRUCE LEHMAN

*Attesting Officer*

*Commissioner of Patents and Trademarks*